US005252415A

United States Patent [19]

Yoshizawa et al.

[11] Patent Number: 5,252,415

[45] Date of Patent: Oct. 12, 1993

[54] DOT-IMAGE FORMING METHOD AND THE PHOTORECEPTOR THEREFOR

[75] Inventors: Hideo Yoshizawa; Yoshihide Fujimaki, both of Hachioji, Japan

[73] Assignee: Konica Corporation, Japan

[21] Appl. No.: 624,394

[22] Filed: Dec. 7, 1990

[30] Foreign Application Priority Data

| | | | |
|---|---|---|---|
| Dec. 11, 1989 | [JP] | Japan | 1-321856 |
| Dec. 11, 1989 | [JP] | Japan | 1-321859 |
| Dec. 28, 1989 | [JP] | Japan | 1-339744 |
| Feb. 28, 1990 | [JP] | Japan | 2-45298 |

[51] Int. Cl.[5] ..... G03G 5/07

[52] U.S. Cl. ..... 430/31; 430/56; 430/83

[58] Field of Search ..... 430/31, 56, 83, 78, 430/84

[56] References Cited

U.S. PATENT DOCUMENTS 4,175,955 11/1979 Seino et al. ..... 430/35

4,925,757 5/1990 Takenouchi et al. ..... 430/31

FOREIGN PATENT DOCUMENTS 1253887 11/1971 United Kingdom .

1366052 9/1974 United Kingdom .

1535426 12/1978 United Kingdom .

2058400 4/1979 United Kingdom .

*Primary Examiner*—Marion E. McCamish

*Assistant Examiner*—S. Rosasco

*Attorney, Agent, or Firm*—Jordan B. Bierman

[57] ABSTRACT

The invention provides a method of forming an image on a photoreceptor indicating a maximum value of the differential coefficient to the exposure in the light decay curve thereof. The method comprises charging the surface of the photoreceptor; exposing uniformly the surface of the photoreceptor at the same time or substantially at the same time with the step of the charging; forming a latent image on the surface of the photoreceptor by a dot-wise image exposure; and developing the latent image on the surface of the photoreceptor.

7 Claims, 7 Drawing Sheets

DOT-IMAGE FORMING METHOD AND THE PHOTORECEPTOR THEREFOR

BACKGROUND OF THE INVENTION

This invention relates to a photoreceptor and, particularly, to an electrophotographic photoreceptor.

Further, this invention relates to an image forming method and the apparatus therefor and, particularly, to an image forming method suitable for forming a dot-image by dotwise exposing of a beam for exposure according to a digital signal and the apparatus therefor.

Heretofore, as the photoreceptors applicable to electrophotography, those having the so-called low $\gamma$ type light decaying characteristics, that is slow in light decay, are known, as shown in FIG. 6A and, on the other hand, those having the so-called high $\gamma$ type light decaying characteristics, that is slow in light decay at the initial stage of an image exposure and sharp in the light decay at the middle and late stages are also known, as shown in FIG. 6B.

The reason why the high $\gamma$ type photoreceptors can show the above-mentioned excellent characteristics is still not fully made clear. It is, however, presumed that, at the initial stage of the image exposure, carriers produced on the surface of a photosensitive substance which particularly, made of a photoconductive organic pigment, are trapped thereon for a little while to delay the light decay and the carrier trapping is then saturated at the middle and late stages of the exposure to produce resultingly an avalanche phenomenon at a stroke, so that the light decaying characteristics may be shown to decay almost straight.

The characteristic of the above-mentioned high $\gamma$ type photoreceptor is to have a maximum value of the differential coefficient on the light decay curve drawn by plotting the surface potentials of the photoreceptor to the exposure amount; there, the both axes of the surface potential and the exposure are not ploted in linear scales not in terms of logarithm. The term, 'a light decay curve', herein defines the relation between the surface potential of photoreceptor and an exposure amount when the photoreceptor is given a certain light exposure and, in the curve, the surface potential of photoreceptor is taken on the ordinate and an exposure irradiated to the surface of the photoreceptor is taken on the abscissa. In FIG. 6B, the exposure is taken in terms of exposure time. With respect to the curve, the term, 'differential coefficient' means an inclination of the tangential line to the light decay curve (a) and is defined approximately as a absoute value of $\Delta V/\Delta I$ where the surface potential of a photoreceptor is changed from $V_O$ into $V_0+\Delta V$ when a certain exposure $I_O$ is increased by $\Delta I$. FIG. 7 shows the differential coefficient-exposure characteristics on a light decay curve obtained in the above-described method of obtaining an approximate differential coefficient, wherein curve A having the maximum value corresponds to curve (a) shown in FIG. 6B and curve (A') corresponds to light decay curve (a') shown in FIG. 6A.

In the engineering field of electrography in recent years, the image forming methods have been extensively researched and developed by adopting the digital system capable of readily making the improvements of image qualities and the conversions and compilations of images so that high-quality images can be formed. In such image forming methods, the photoreceptors having the above-mentioned high $\gamma$ type light decaying characteristics can advantageously be used. For example, the light beam, of a laser, preferably, a semiconductor laser, a LED array and a liquid crystal shutter are modulated by the digital image signals given through a computer from an original document subject to copy and a uniformly charged photoreceptor is exposed dotwise by the modulated light image, so that a dot-shaped electrostatic latent image may be formed. When a dot-shaped image is formed by processing the resulting latent image with toner, preferably, in a reversal development, an exposure is usually made dotwise at a luminance within the range of 1 to 5 mw with an extremely narrow dot width within the range of 50 to 100 $\mu$m.

In the case of such a narrow dot width exposure as mentioned above, the high $\gamma$ type photoreceptors have a short and sharp skirt portion in both of the potential distribution of the dot-shaped electrostatic latent image and the density distribution of the dot-shaped image. Therefore, the photoreceptors of this type are advantageous to the digital system image formation.

The image forming apparatuses applicable with the high $\gamma$ type photoreceptors include, for example, the apparatus schematically shown in FIG. 9. In the figure, referential numeral 1 is a photoreceptive drum, 2 is a charger, 3 is a light input signal, 5 is a developing unit, 6 is a cleaning section, 7 is a transfer paper, and 8 is a transfer charger. The image forming apparatus shown in FIG. 10 is that disclosed in Japanese Patent Publication Open to Public Inspection-hereinafter referred to as Japanese Patent O.P.I. Publication-No. 172863/1989, wherein to the light input signal 3 of the apparatus shown in FIG. 9, another light input 4 having a uniform intensity for sensitization use is added.

In the meantime, the above-described high $\gamma$ type photoreceptors are advantageous to the digital recording systems. However, these photoreceptors have the following problem. As shown by (b) in FIG. 6B, there is an induction period from starting an exposure to the time of rapidly lowering the surface potential, i.e. the time of rapidly causing an avalanche phenomenon, so that an absolute sensitivity becomes low. Therefore, the exposure should be increased more than usual.

As shown in FIG. 10, therefore, when light input 4 for sensitization is applied, it is reasonably expectable to obtain the effects on the compensation for the short exposure and the increase in apparent sensitivity. However, as the original light input 3 and another light input 4 are applied at the same time, an interference is occured between the two inputs, thereby producing an unevenness on the electrostatic latent image, or the image, so that a uniform image cannot be formed.

It is an object of the invention to provide a method capable of improving a sensitivity, forming a uniform latent image and obtaining an excellent image; and to provide the apparatus therefor.

The photoreceptors showing the above-described high $\gamma$ type light decaying characteristics are excellent in the reproducibility of thin-line portions or character portions among the image areas as compared to the other normal type photoreceptors. However, the photoreceptors of this type have the defect that the density of a over-all solid image is lowered.

Another object of the invention is to provide a method of obtaining an image excellent in the resolving power of the thin-line portions and satisfactory in the density of an overall solid image, not losing the special features of the photoreceptors having the above-described high $\gamma$ type light decaying characteristics.

When the photoreceptor having the characteristics shown by curve A exhibited in FIG. 7 is exposed to laser beam, the surface potential $V_H$ thereof in an unexposed area is still high in the initial stage. However, the potential $V_H$ is lowered as the photoreceptor is repeatedly used. On the other hand, the surface potential $V_L$ thereof in an exposed area is also lowered accordingly. In other words, the photoreceptors having the high $\gamma$ type light decaying characteristics are not effectively used, because they have the defect that the light decay curve is varied to deteriorate the receptors in the course of repetition use, although they have the special features such as a sharp light decay in the late stage of exposure and the high gamma characteristics. For example, they have the following defects. A fog is produced on an image area and an erratic developability is also produced, because $V_H$ is seriously lowered in the order of 100 copy cycles and $V_L$ is high in the initial stage.

In addition to the above, in electrophotographic processes, ozone or other active substances are derived from the charging by a corona discharge and the photoreceptors are affected by the above-mentioned active substances so as to raise the problems such as the deterioration of charging characteristics and sensitivity, and the raise of residual potentials. Particularly in the repetition use, the time of exposing the photoreceptors to ozone or other active substances are increased progressively and, therefore, the lowering of the charging characteristics and sensitivity, and the residual potential's rise occur seriously.

Even if adding the antioxidant as described in, for example, Japanese Patent O.P.I. Publication Nos. 130759/1981, 73744/1982 and 122444/1982 for the countermeasure to solve the above-mentioned defects, there still remain the following defects. The photoreceptors having the excellent charging characteristics will cause the deterioration of the initial sensitivity; those having an excellent initial sensitivity will not improve the deterioration in repetition use; and those having the less deterioration in repetition use are not satisfactory in the initial sensitivity and the charging characteristics.

A further object of the invention is to provide a photoreceptors having the above-described high $\gamma$ type light decaying characteristics, which are capable of stabilizing the potentials in repetition use and, at the same time, improving the initial sensitivity.

Notwithstanding the conventional high $\gamma$ type photoreceptors are required to have still more higher $\gamma$ type light decaying characteristics, none of any photoreceptors capable of satisfying the requirement is still practically known. In addition to the above, though the stability in repetition use is also demanded, it is the actual situation where any satisfactory countermeasure is still not taken.

Yet another object of the invention is to provide a photoreceptor capable of improving the sensitivity to make the high $\gamma$ type light decaying characteristics more higher and stabilizing the characteristics in repetition use.

SUMMARY OF THE INVENTION

The first object of the invention can be achieved in an image forming method, wherein the following treatments are carried out to a photoreceptor having a maximum value of the differential coefficient to the exposure in order; namely, a charging; a uniform exposure made at the same time or approximately at the same time when applying the charge; the formation of an electrostatic latent image made by a dot-exposure; and the development of the electrostatic latent image.

This invention also provides an image forming apparatus comprising a photoreceptor showing the maximum value of the differential coefficient to the exposure amount on the light decay curve of the surface potentials of the photoreceptor, being arranged in order around which with a charging means, a light-exposing means for making an exposure at the same time or approximately at the same time when charging with the charging means, and a developing means for developing the electrostatic latent image thereby formed.

The second object of the invention can be achieved in the image forming process where the charging and the simultaneous (or almost simultaneous) uniform light exposing are given to a photoreceptor showing the maximum value of the differential coefficient to the exposure amount on the light decay curve of the surface potentials of the photoreceptor, and then the dot-wise light image exposure is made to make an electrostatic latent image which is followed by the development to make a visible image. Wherein, following choice can be taken, i.e., the over-all solid area is exposed uniformly to the light more than that to the thin-line area, or when only the dot-exposure is performed without the uniform exposure, the dotwise writing exposure to the over-all solid area is increased more than that to the thin-line character area. (Jp-17, Ep-9) The amount of the above-mentioned 'exposure' can be adjusted by changing an exposure energy when an exposure time is fixed, by changing an exposure time when an exposure energy is fixed, or, by changing both of an exposure energy and an exposure time.

The third object of this invention will be achieved by the following process. i.e., the charging and the simultaneous (or almost simultaneous) uniform light exposing the photorecepter surface which has a maximum value of the differential-coefficient on the light decay curve of the surface potential plotted the differential-coefficient to the exposure amount are carried out, and the dot-wise light image exposure is performed to make a latent image which is followed by the development to make a visible image, wherein, the uniform light exposure amount is controlled according to the number of the repetition of the copy process cycle. (Jp-17L, Ep-9L)

Or this third object of the invention can be achieved with a photoreceptor having the maximum value of the differential coefficient to the exposure amount on the light decay curve thereof, wherein the photoreceptive layer contains a phthalocyanine pigment, an antioxidant having a hindered phenol structural unit and an alectron-acceptive substance, and the proportion of the antioxidant and the electron-donative substance each to the phthalocyanine pigment, in terms of weight proportion, is as follows:

$$0.1 \leqq \frac{\text{Antioxidant}}{\text{Phthalocyanine pigment}} \times 100 < 50$$

$$0.1 \leqq \frac{\text{Electron-acceptive substance}}{\text{Phthalocyanine pigment}} \times 100 < 40$$

The fourth object of the invention can be achieved with a photoreceptor showing the maximum value of the differential coefficient to the exposure amount on the light decay curve of the surface potential thereof, and containing the titanate type compound represented by the following formulas A, B and C:

Formula A:

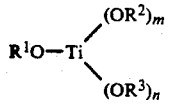

wherein $R^1$, $R^2$ and $R^3$ represent each a hydrogen atom, a substituted or unsubstituted allyl group, a substituted or unsubstituted aryl group, a substituted or unsubstituted heterocyclic group, a substituted or unsubstituted alkyl group, or one of the groups represented by the following formulas:

Formulas:

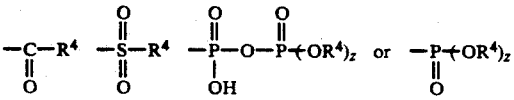

wherein $R^4$ represents a hydrogen atom, a substituted or unsubstituted allyl group, a substituted or unsubstituted aryl group, a substituted or unsubstituted heterocyclic group, a substituted or unsubstituted alkyl group, or a substituted or unsubstituted amino group, and m and n are each an integer of 0, 1, 2 or 3.

Formula B:

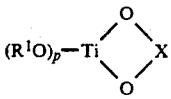

wherein $R^1$ is synonymous with the above-denoted $R^1$, X represents a cycloalkane forming group, a cycloalkene forming group, a heterocyclic ring forming group, or a cycloalkylketone ring forming group, and p is an integer of 0, 1, 2 or 3.

Formula C:

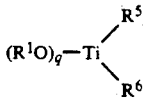

wherein $R^1$ is synonymous with that denoted above, and $R^5$ and $R^6$ are each one of the groups represented by the following formula:

Formula:

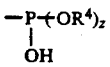

wherein $R^4$ is synonymous with that denoted above, and q is an integer of 1, 2, 3 or 4.

BRIEF DESCRIPTION OF THE DRAWINGS

FIGS. 1 through 5 illustrate each the invention; among them,

FIGS. 2 and 3-*a* through 3*c* are the fragmentary cross-sectional views of the examples of photoreceptors, respectively;

FIG. 4 is a schematic graph exhibiting the light decay characteristics of a photoreceptor; and FIG. 5 is a schematic illustration of the substantial part of the other image forming apparatus.

FIG. 7 exhibits the relation of the differential coefficient to the exposure amount on light decay curves, respectively;

FIG. 8 is a schematic graph exhibiting the surface potentials varied by processing a photoreceptor in repetition; and FIGS. 9 and 10 are each schematic cross-sectional views of image forming apparatuses, respectively.

DETAILED DESCRIPTION OF THE PREFERRED EMBODIMENTS

Figure 1A:
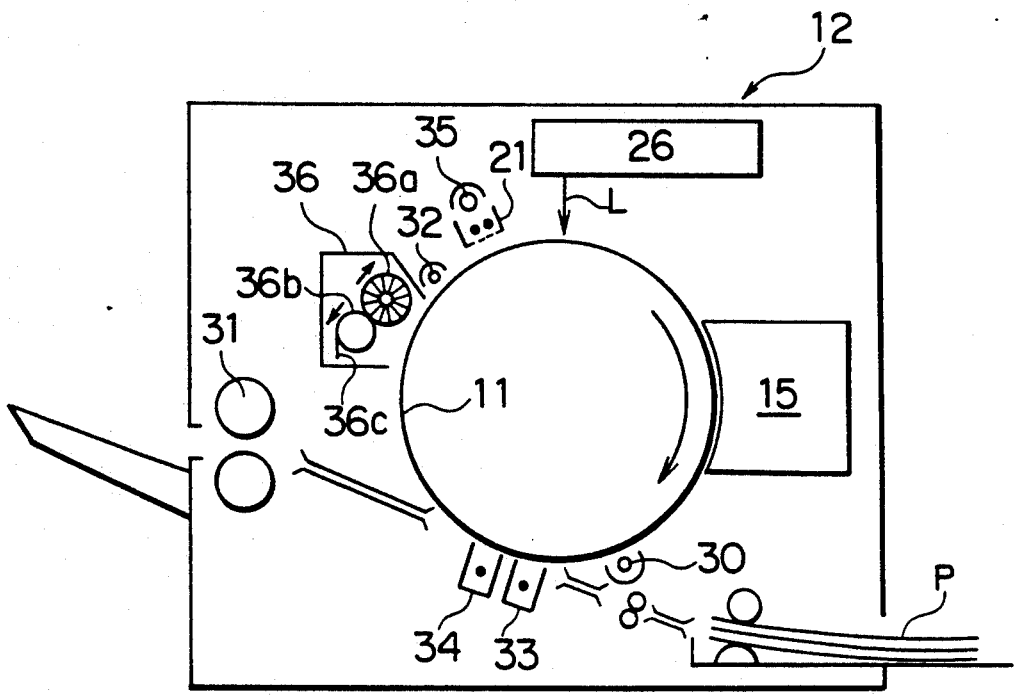
FIG. 1*a* and 1*a'* is a schematic cross-sectional view of an image forming apparatus.
Figure 1A:
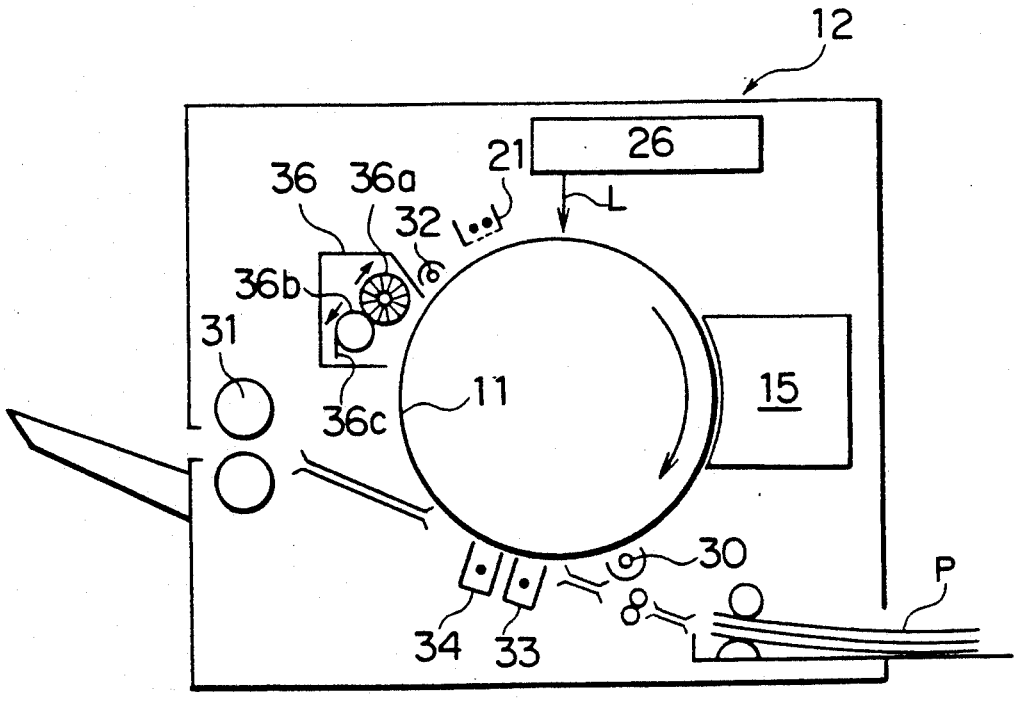
Figure 1B:
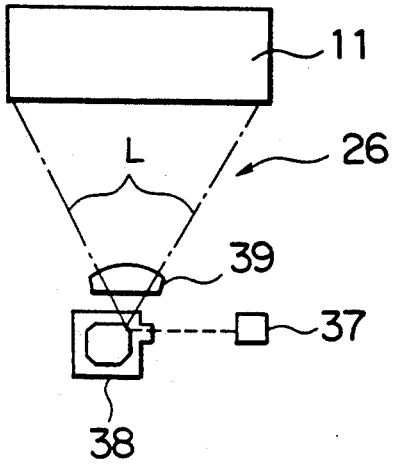
FIG. 1*b* is a schematic illustration of a laser beam optical system.
Figure 2:
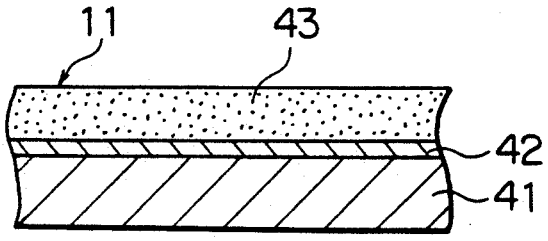
Figure 3A:
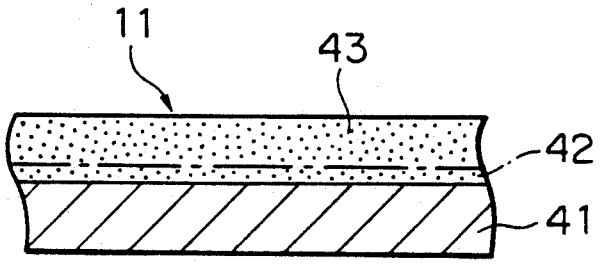
Figure 3B:
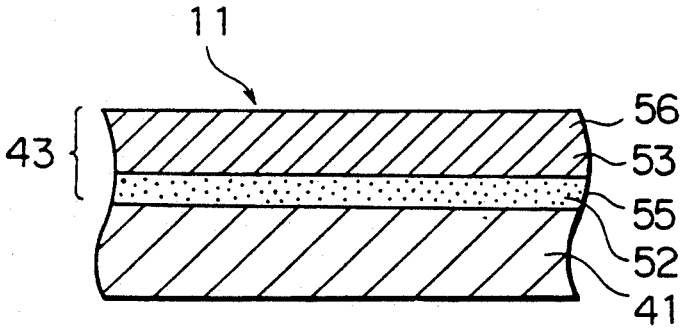
Figure 3C:
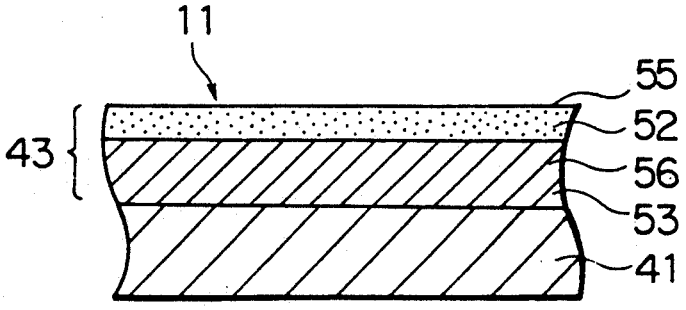

Referring to FIGS. 1 through 3, the examples of the image forming method and the apparatus each of the invention will be detailed.

In FIG. 1*a* and 1*a'* reference numeral 11 is a photoreceptor relating to the invention which rotates in the direction of the arrow mark; 21 is a corona charger; reference character L is a dot-image exposure light emitted from optical system 26 such as a semiconductor laser; 15 is a developing unit; 30 is a lamp for pretransferring exposure; 31 is a fixing unit; 32 is a lamp for precharging exposure; 33 is an image transfer electrode; 34 is a separation electrode; P is a transfer paper; 35 is a lamp for uniform exposure; and 36 is a cleaning unit, in which 36*a* is a fur brush, 36*b* is a toner recovery roller and 36*c* is a scraper; besides, developing unit 15 may be of the monochromatic or monocolor system and, for obtaining a multicolor image, developing units using yellow, magenta, cyan and black toners therein are provided, respectively.

Figure 6A:
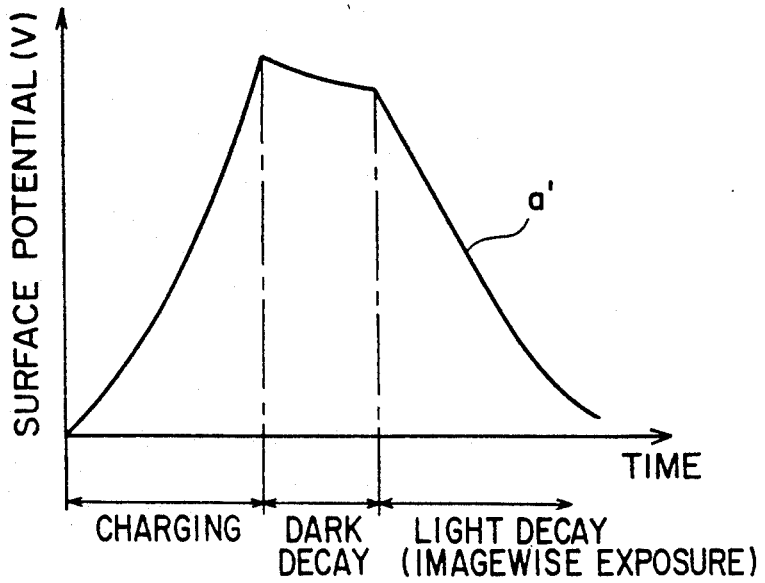
FIGS. 6 through 10 illustrate each the examples of the conventional embodiments; among them, FIG. 6(A) schematically exhibits low $\gamma$ type light decay characteristics.
FIG. 6(B) schematically exhibits high $\gamma$ type light decay characteristics.
Figure 6B:
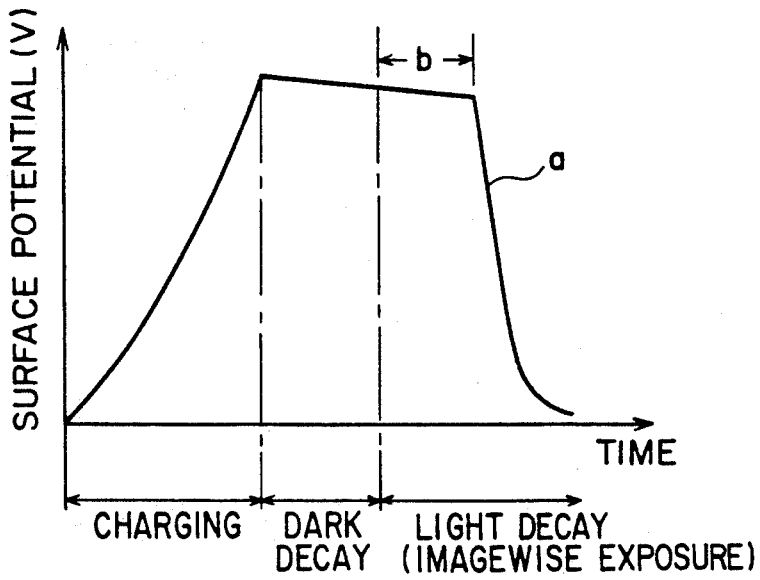
Figure 7:
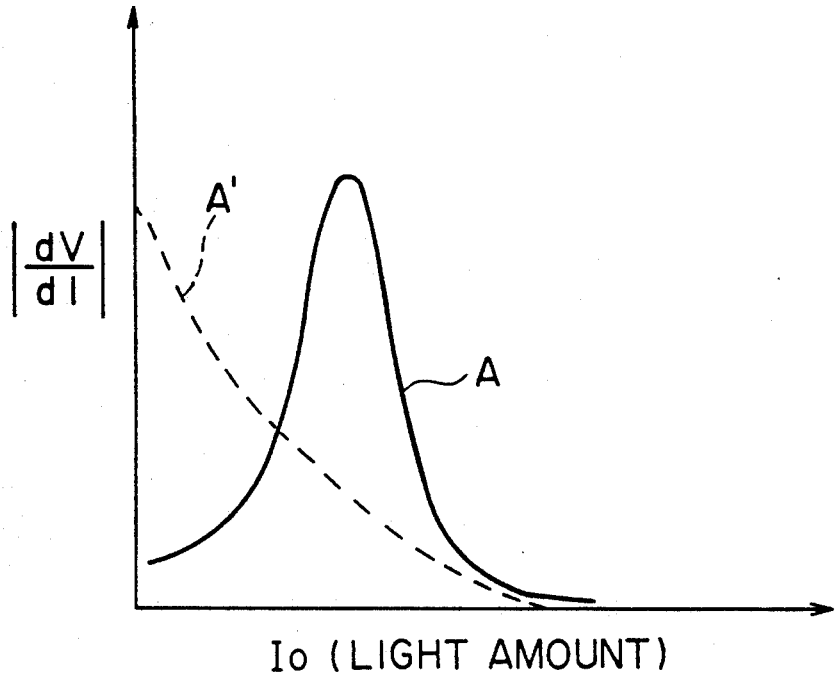
Figure 8:
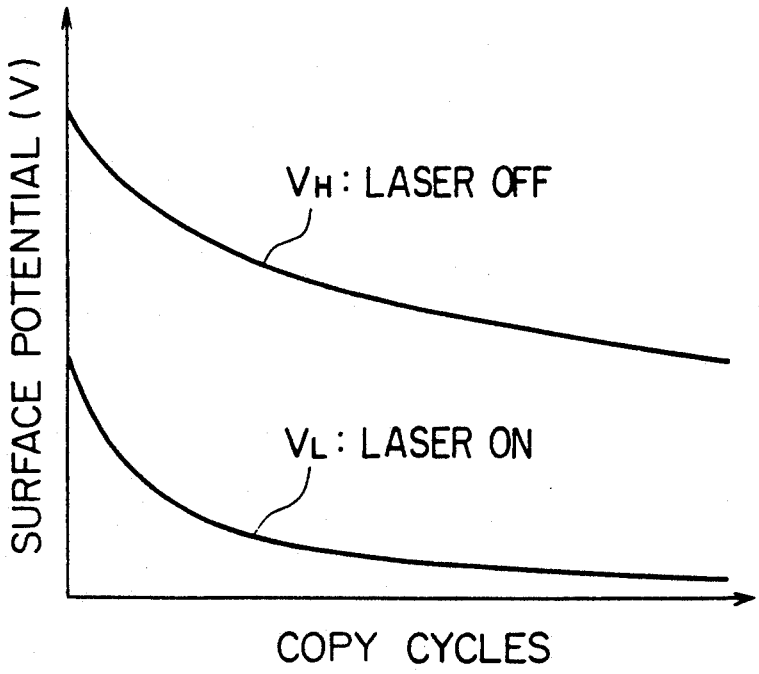

Photoreceptor 11 shows the high $\gamma$ type light decaying characteristics illustrated in FIG. 6(B), FIG. 7 and FIG. 8. The surface thereof is uniformly charged by corona charger 21 comprising a scorotron charging electrode and, at the same time of the charging, the photoreceptor is uniformly exposed to infrared rays from exposure lamp 35 and is then successively irradiated thereon with dot-image exposure light L emitted from laser optical system 26 according to every image recording data. A latent image is thereby formed and is then developed by toner-containing developing unit 15.

Photoreceptor 11 formed a toner image thereon is uniformly irradiated with pretransferring exposure lamp 30 if required, and the toner image is then transferred onto transfer paper P by image transfer electrode 33. Transfer paper P is separated from photoreceptor 11 by separation electrode 34 and is then fixed by fixing unit 31. In this case, pretransferring exposure 30 may not necessarily be needed and, in place thereof, an electric neutralization by A.C. may be applied. On the other hand, photoreceptor 11 is cleaned by cleaning unit 36. In cleaning unit 36, fur brush 36*a* is kept untouched to photoreceptor 11 while forming an image and, when a residual toner image is on photoreceptor 11 after the toner image is transferred, the fur brush 36*a* is brought into contact with photoreceptor 11 and is then rotated in the direction of the arrow mark to scrape away the remaining toner after completing the transfer of the toner image.

When completing the cleaning of photoreceptor 11, fur brush 36*a* is separated again from photoreceptor 11. Toner recovery roller 36*b* is applied with an appropriate bias while rotating in the direction of the arrow mark so that the remaining toner may be recovered. The recovered toner is further scraped away by scraper 36*c*.

FIG. 1-*b* shows laser optical system 26 of this preferred embodiment, wherein 37 is a semiconductor laser diode, 38 is a rotary polygonal mirror and 39 is a f$\theta$ lens.

FIG. 2 shows an typical constitutional example of photoreceptor 11, wherein 41 is a conductive support member, 42 is an interlayer, and 43 is a photoreceptive layer.

Photoreceptive layer 43 may be formed in the following manner:

A photoconductive organic pigment, a binder resin and, if required, an antioxidant are mixedly dispersed with a solvent for the binder resin so as to have a fine particle-size within the range of 0.1 to 1 $\mu$m, thereby preparing a coating solution; and the resulting coating solution is coated on interlayer 42, dried and, if required, heat-treated.

For conductive support member 41, a plate or drum made of a metal such as aluminium, steel or copper may be used, and those comprising a metal layer laminated or vacuum evaporated on a sheet of paper or a plastic film may also be used.

For interlayer 42, the layers made of, for example, polyvinyl alcohol or polyvinyl methyl ether, which are commonly used with photoreceptive layers for electrophography, may be used.

Among the photoreceptive substances applicable to photoreceptive layer 43, the photoconductive organic pigments, which are suitable for the cases where a semiconductor laser beam is used for making an imagewise exposure, include for example, the following pigments; namely, the bisazo pigments, trisazo pigments, tetraazo pigments and polycyclic quinone type pigments each disclosed in Japanese Patent O.P.I. Publication No. 14157/1987, the titanium type phthalocyanine pigments disclosed in Japanese Patent O.P.I. Publication Nos. 109056/1986 and 217050/1986, the X type non-metallic phthalocyanine pigments disclosed in Japanese Patent Exanined Publication No. 4338/1974, the $\tau$ type non-metallic phthalocyanine pigment disclosed in Japanese Patent O.P.I. Publication No. 183757/1983, the $\epsilon$ type copper phthalocyanine pigment disclosed in Japanese Patent O.P.I. Publication No. 1662/1977, the $\beta$ type non-metallic phthalocyanine pigment disclosed in Japanese Patent O.P.I. Publication No. 59468/1980, the azulenium salt pigments disclosed in Japanese Patent O.P.I. Publication No. 15147/1986, the trisazo type pigments disclosed in Japanese Patent O.P.I. Publication Nos. 205746/1982, 205747/1982 and 206658/1982, and the scandium type pigments disclosed in Japanese Patent O.P.I. Publication No. 105536/1974.

The binder resins include, for example, an acryl resin, a polycarbonate resin, a silicone resin, a denatured silicone resin, a melamine resin, a urea resin, a polyester resin, an alkyd resin, a polyurethane resin, an epoxy resin, a phenol resin, a furan resin, a xylene resin, a petroleum resin, a variety of cellulose derivative resins, the compounded resins thereof, and the like. Among them, the preferable binder resins include, for example, the compounded resins of a thermosetting acryl resin and a melamine resin, those further containing a thermosetting epoxy resin, or the compounded resins of a thermosetting silicone resin and an acryl resin.

Photoreceptive layers 43 are also allowed to contain, besides the above, the electron acceptive substances such as anhydrous succinic acid, anhydrous phthalic acid, and anhydrous tetrachlorophthalic acid, and the antioxidants such as a hindered phenol, a paraphenylenediamine, a hydroquinone, an organic sulfur compound and an organic phosphorus compound.

The thickness of photoreceptive layer 43 is desirably of the order of 5 to 200 $\mu$m and preferably within the range of 10 to 100 $\mu$m. If the thickness thereof is too thin, a high electric chargeability can hardly be obtained and high gamma characteristics can also hardly be obtained, notwithstanding such characteristics ought to be obtained by an avalanche phenomenon. On the other hand, if the thickness thereof is too thick, the light decay characteristics has a long skirt portion on the characteristic curve so that a dot image having a high sharpness can hardly be obtained, though a high chargeability may be thereby provided.

When forming an image with the above-described photoreceptor 11 in the digital system, a remarkable point is that an electric charge by means of charger 21 and a uniform exposure by means of lamp 35 are carried out at the same time and in the same position in the preceding step of dot-exposure L so as to achieve the first object of the invention.

To be more concrete, photoreceptor 11 has the high $\gamma$ type light decay characteristics as shown in FIG. 6B and as indicated by curve A drawn in FIG. 7 and an induction period for which the surface potential of photoreceptor 11 is not lowered so much after starting an imagewise exposure, so that the photosensitivity is not enough. Therefore, it was already described in the previous paragraph that an exposure amount has so far been necessary more than usual. However, in accordance with the invention, as described above, it was discovered that, when a uniform exposure is made by lamp 35 at the same time of charging with charger 21, the induction period after starting the next imagewise exposure can be shortened from b to $b_1$ as indicated by $a_1$ drawn in FIG. 4. In short, a time for lowering the surface potential to a predetermined level can be shortened and the apparent sensitivity of a photoreceptor can also be improved.

The reason thereof may be presumed as follows: When a uniform exposure is made by lamp 35 in an electric-charging step before an imagewise exposure is made, charge carriers produced in a photoreceptive layer in the uniform exposure are effectively trapped in a trapping level and, therefore, the trapping level is saturated immediately by the charge carriers produced by the imagewise exposure. It may be resultingly considered that an exceedingly rapid avalanche phenomenon is occured at the middle and late stages of the imagewise exposure and further excellent extra-high gamma characteristics can be displayed.

The above-mentioned simultaneous charge-and-exposure operation does not produce any potential difference which may be produced by only an exposure. To be more concrete, even in case where the numbers of the trapping levels become different at each place and the numbers of carriers trapped by an exposure become different thereby causing the charging potentials to be different, a satisfactory charging can be so performed as to solve the above-mentioned differences by applying a charge by the same time exposure. Therefore, any uneven charges cannot be produced and the next imagewise exposure can advantageously be performed. This embodiment is quite different fundamentally from the embodiment example shown in FIG. 10 on the point that a uniform exposure is made separately from an imagewise exposure. Therefore, the imagewise exposure is not interfered in the uniform forming of an electrostatic latent image without any unevenness, so that a high-quality image can be obtained.

A desired light decay can be realized without increasing an exposure amount for am imagewise exposure, because the apparent sensitivity of a photoreceptor can be improved by a simultaneous charge-and-exposure operation, as described above. This point is also advantageous to prevent a photoreceptor from the deterioration of the characteristics thereof caused by the fatigue by light.

In this instance, as described on FIG. 8, a photoreceptor itself has the characteristics that the charge potential and the potential in an exposed area are lowered in repetition use. It is, therefore, desirable to control or, usually, reduce the exposure amount in the above-mentioned simultaneous charge-and-exposure operations every time or stepwise to meet the frequency of the exposures in repetition. Thereby, a fixed light decay curve, i.e., a fixed light sensitivity, can desirably be obtained and excellent images can be formed repeatedly. It may be considered that the reason why an exposure amount is to be reduced to meet the frequency of the repeating exposures may be that the degree of filling of the trapping levels is increased to be saturated depending on the repetition steps and thereby the induction period may be shortened, by the same reason as mentioned before.

The above-described photoreceptors have the problem that, on the images obtained, the reproducibility of the thin-line portions such as the character portions and the reproducibility of the over-all solid image portions cannot be equal, so that the densities of the over-all solid image portions are rather liable to be lowered.

For a measure to counter the problem, that is, for achieving the second object of the invention, the uniform exposure to the over-all solid area is increased more than that to the thin-line portion, or the dot-exposure amount to the over-all solid image portion is increased more than that to the thin-line portion, thereby every necessary exposure amount can be given to each image portion so as to make the densities of the over-all solid image portion sufficient and to make the resolving power of the thin-line portion excellent. (Jp-33, Ep-21) Particularly in the reversal development systems where a potential dropped by an imagewise exposure mainly effects the image density, an image quality is detriorated, because the density of an image is lowered directly by the lack of exposure amount to an over-all solid image portion. When the exposure amount to the over-all solid image portion is increased by controlling the above-mentioned dot-exposure amount and or the uniform exposure amount, the image densities in the both image portions and the resolving power of the thin-line image portions can be sufficient. (Jp-33L, Ep-22T)

In the above-mentioned case, the exposure amount to the thin-line image portions may be different from -or may be smaller than- those to the over-all solid image portions in the methods including, for example, a method in which the exposure energy is changed when the exposure time is fixed on every image portion; another method in which the exposure time is changed when the exposure energy is fixed; or a further method in which both of the exposure energy and the exposure time are changed.

The total exposure amount (which means that the sum of the uniform exposure amount and the dot-exposure amount, or only the dot-exposure amount when the uniform exposure is ommited) to the over-all solid image portion is, usually, 1.1 to 50 times as much as those to the thin-line image portion and, preferably, 1.1 to 20 times as much. (Jp-34, Ep-22)

In the method of the invention and the apparatus therefor, the preferably applicable light beam for dot-exposure includes, particularly, semiconductor lasers such as those of Ga, Al and As.

When using the semiconductor lasers, it is allowed to form a dot-shaped electrostatic latent image having a high image-sharpness, because a laser beam having an extremely narrow spot-width can be generated. Besides the above-given semiconductor lasers, it is also allowed to use the gas lasers such as those of He-Ne, He-Cd and Ar.

It is allowed to select any rays of light having suitable wavelengths for giving a uniform exposure when charging and exposing are done simultaneously. It is, however, desired to use infrared rays for preventing the decrease of the light amount caused by the light absorption of toner on a photoreceptor when forming a multicolored image.

For the light sources for giving the uniform exposure, besides a halogen lamp and a tungsten lamp, it is also allowed to use, for example, a fluorescent lamp and an LED each applicable to an image-transfer type copier. To be more concrete, for example, a narrow wavelength range corresponding to the absorption wavelength region of a photoreceptor is taken out by use of, for example, a tungsten lamp having color temperature of 2854° K. attached with an dichroic filter KL 45, 50, 55, 60, 65, 70 and 80 -manufactured by Toshiba Kasei Kogyo Co. and a colored-glass filter in combination, and, thereby the rays of light having the narrow wavelength range can be used as a uniform exposure light.

A dot-shaped electrostatic latent image is formed on a photoreceptor by a dot-exposure by an exposing beam, and the resulting latent image is developed, in a developing step, by use of a mono- or dual component type developer containing finely grained toner having an average particle-size within the range of 1 to 20 μm.

As for the development systems, a contact-reversal development system may be adopted. On the other hand, in a colored image forming methods in which a colored image is formed in the manner that each colored image is superposed on a photoreceptor and they are transferred en bloc onto a transfer member and are then fixed thereonto, it is allowed to adopt a development system in which a high-frequency AC bias is applied to a developing area so that toner may jump up to carry out a non contact reversal development. For the details, refer to Japanese Patent O.P.I. Publication No. 184381/1983.

In the invention, even if adopting a contact-reversal development system, the development is preferably carried out by applying an AC bias to the developing areas, because the development of a sharp image can be performed to enjoy the advantages that toners are pressed vertically to the latent image surface on a photoreceptor by the AC bias and the latent image can be uniformed and sharp on the whole surface.

Figure 5:
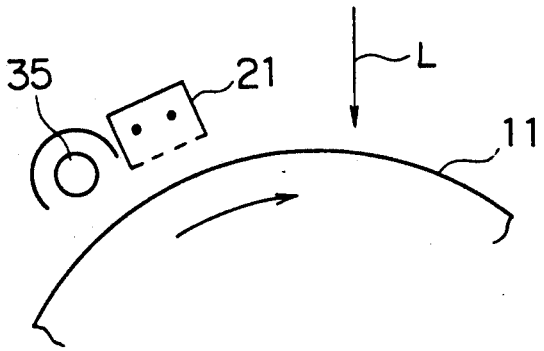

In FIG. 5, different from the already described example shown in FIG. 1-*a*, exposure lamp 35 is installed at immediate upstream position of charger 21.

In this example shown in FIG. 5, therefore, an electrostatic charging and an exposure can be carried out almost at the same time, though the two operations may be carried out close one after another. For this reason, the effects equivalent to those of the above-described simultaneous charging and exposing operation can be enjoyed and, in addition, it can be expected to use an ordinary type scorotron charger as charger 21 and to improve the efficiency of an exposure because the exposure can be made close to a photoreceptor.

In the examples shown in FIGS. 1-*a* and 5, it is allowed to carry out an additional charging with another charger after the completion of charging by charger 21 and thus, if the charge is insufficient, the supplementation may be carried out thereto.

EMBODIMENT -[I]

Some embodiments each for achieving the first object of the invention will now be detailed. It is, however, to be understood that the embodiments shall not be limited to the following examples.

EXAMPLE FOR PREPARING A PHOTORECEPTOR

The coating solution having the following composition was coated on the aluminium-made tube for the photoreceptor drum attached to a digital copier, Model DC-8010 manufactured by Konica Corp.

| | |
|---|---|
| X-type metal-free phthalocyanine pigment, Fastogen Blue 8120S manufactured by Dai-Nippon Ink Co. | 20 parts by wt. |
| Polycarbonate, Panlite K-1300 manufactured by Teijin Corp. | 80 parts by wt. |
| 1,2-dichloroethane | 1000 parts by wt. |

The slurry prepared by dispersing of the above composition by a sand grinder for 2 hours was coated on the aluminium-made tube in a dipping method and dried up with heating at 100° C., so that a photoreceptive layer having a layer thickness of 15 μm could be prepared. Under the photoreceptive layer, a polyvinyl alcohol-made interlayer was provided in advance so as to have a thickness of several μm.

At the same time, a sheet-shaped sample was prepared in the manner that a 75 μm-thick polyethylene terephthalate film sheet to which aluminium film had been adhered was wrapped around the aluminium-made tube, and a photoreceptive layer could be formed in the same manner as in the above-described case.

The resulting sheet sample was evaluated in the following processes with the use of a photoreceptive material tester, Model EPA-8100 manufactured by Kawaguchi Electric Co. This process corresponds to the pattern shown in FIG. 4.

In this measurement, the test cycle was performed according to the next process.

A precharge exposure <at 200 lux·sec and for 2 sec.>→a simultaneous charging exposing <at 2 lux·sec. and for 3 sec.>→an allowance to stand in the dark <for 5 sec.>→an imagewise exposure <at 0.4 μw>→return to the start.

EXAMPLE I-1

A black-and-white image was formed in the following manner:

The photoreceptive drum made as described above was loaded on a digital type copier, the remodeled DC-8010 manufactured by Konica Corp. shown in FIG. 1-*a*; after the surface of the photoreceptor —the surface of the drum— was uniformly charged and exposed to light simultaneously at 2 lux·sec., a dot-shaped electrostatic latent image was formed by exposing the surface of the photoreceptor to the semiconductor beams modulated by digital signals; the electrostatic latent image was developed with a dual component type developer comprising nonmagnetic toner having an average particle-size of 5 μm and resin coated ferrite carrier having an average particle-size of 20 μm, in a contact-reversal developing method, in the state where a DC 500 V was kept applying between the development gap; and the developed image was transferred to a sheet of plain paper and the transferred image was then fixed.

COMPARATIVE EXAMPLES I-1 AND I-2

Figure 9:
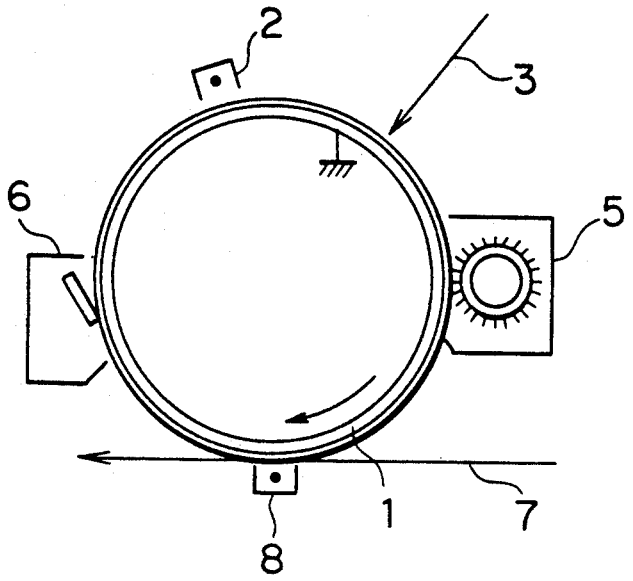
Figure 10:
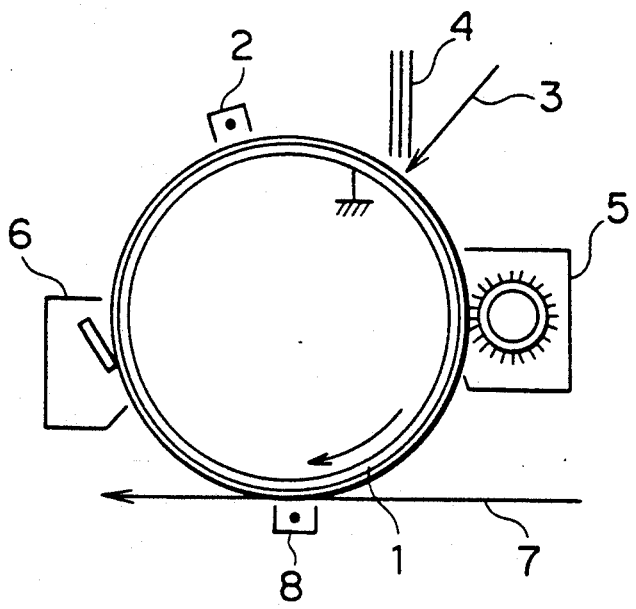

In these examples, the images were formed in the same manner as in the preceding example, except that the device —for Comparative Example I-1— shown in FIG. 9 and the device —for Comparative Example I-2— shown in FIG. 10 were used and the same simultaneous charing and exposing operation as in Example 1 was not carried out, but, in Comparative Example I-2, the uniform exposure amount for exposure 4 was given at 2 lux·sec. to the surface of the drum.

The results obtained from these examples are shown in Table I-1 below.

TABLE I-1

| | Inventive Example I-1 | Comparative Example I-1 | Comparative Example I-2 |
|---|---|---|---|
| $V_H$ (Initial stage) | 600 V | 600 V | 600 V |
| $V_L$ (Initial stage) | 50 V | 300 V | 70 V |
| Image | Excellent | Skip of some character produced | Uneven solid background produced |

From the above table, it can be found that the photosensitivity was improved to obtain an excellent quality image in the method based on the invention. The same results as in the above could be obtained with the device shown in FIG. 5.

EXAMPLE I-2 AND COMPARATIVE EXAMPLES I-3 AND I-4

In these cases, the light amount for the simultaneous charging exposing operation in Example I-1 was settled by 2.0 lux from starting in the continuous copying operation to the 10th copy cycle, 1.5 lux to the 50th cycle, and 1.0 lux after the 100th cycle respectively. The above-mentioned light amount was reset to 2.0 lux that was the starting light amount, when the stopping of the process exceeds one hour or longer. The results are shown in Table I-2. According to the invention, the excellent repetition process could be established by changing the exposure amount in every cycle and, on the contrary, the poor results were obtained in Comparative Examples.

The same results were obtained also in the device shown in FIG. 5.

TABLE I-2

| | Inventive Example I-2 In Example I-1 | | Comparative Example I-3 In Comparative Example I-1 | | Comparative Example I-4 In Comparative Example I-2 | |
|---|---|---|---|---|---|---|
| | Potential | Image | Potential | Image | Potential | Image |
| Start $V_H$ | 600 V | Excellent | 600 V | Character | 600 V | Unevenness |
| Start $V_L$ | 50 V | | 300 V | skip produced | 70 V | produced |
| 10th cycle $V_H$ | 600 V | Excellent | 550 V | Character | 540 V | Unevenness |
| 10th cycle $V_L$ | 50 V | | 270 V | skip produced | 50 V | produced |
| 50th cycle $V_H$ | 605 V | Excellent | 500 V | Character | 505 V | Unevenness |
| 50th cycle $V_L$ | 45 V | | 200 V | skip produced | 40 V | produced |
| 100th cycle $V_H$ | 600 V | Excellent | 460 V | Fog | 485 V | Unevenness |
| 100th cycle $V_L$ | 45 V | | 170 V | produced | 40 V | produced |
| 500th cycle $V_H$ | 600 V | Excellent | 430 V | Fog | 460 V | Fog |
| 500th cycle $V_L$ | 45 V | | 150 V | produced | 40 V | produced |
| 1000th cycle $V_H$ | 590 V | Excellent | 410 V | Fog | 440 V | Fog |
| 1000th cycle $V_L$ | 40 V | | 140 V | produced | 40 V | produced |

EXAMPLES I-3 THROUGH I-6

These examples were prepared in the same manner as in Example I-1, except that the dot-exposure amount applied to the character image portions and the solid image portions each for example I-1 was changed respectively into those shown in the following Table I-3;

TABLE I-3

| | Laser beam power applied to character image portions | Laser beam power applied to solid image portions |
|---|---|---|
| Example I-3 | 1 mW | 2.5 mW |
| Example I-4 | 2 mW | 3 mW |
| Example I-5 | 2 mW | 4 mW |
| Example I-6 | 0.5 mW | 2.5 mW |
| Comparative example 1-5 | 2 mW | 2 mW |

The individual results of each of the examples are shown in Table I-4. In the examples based on the invention, each of the image densities was greatly improved by the increase in the dot-exposure amount applied to the solid image portions. The results obtained from the device shown in FIG. 5 were also the same as in the above-given examples.

TABLE I-4

| | Character image 400 dpi, 2-dots line interval | Solid image* density |
|---|---|---|
| Example I-3 | Resolved | 1.2 |
| Example I-4 | Resolved | 1.4 |
| Example I-5 | Resolved | 1.4 |
| Example I-6 | Resolved | 1.2 |
| Comparative example 1-5 | Resolved | 0.8 |

*Measuring method: In a 1 $cm^2$ exposed area, an image was formed, and the image density of the area was measured with a Sakura Reflective Densitometer manufactured by Konica Corp.

As described above, the invention can shorten the induction period when starting the next imagewise exposure and can improve the absolute sensitivity of a photoreceptor used, by that the photoreceptor showing a maximum value of the differential coefficient to the light amount is exposed to light at the same time or at the almost same time when applying a charge.

In addition to the above, a potential ununiformity that may be produced by an exposure cannot be produced so that a uniform latent image can be formed, because a charging exposing operation is carried out at the same time or at the almost same time.

EMBODIMENT [II]

An embodiment for achieving the secondary object of the invention will now be detailed.

EXAMPLE II-1 AND COMPARATIVE EXAMPLES II-2 AND II-2

A black-and-white image was formed in the following manner:

The photoreceptive drum made in Embodiment [I] was loaded on a digital type copier, the remodeled DC-8010 manufactured by Konica Corp. shown in FIG. 1-*a;* after the surface of the photoreceptor was uniformly charged, a dot-shaped electrostatic latent image was formed by exposing the surface of the photoreceptor by the semiconductor laser beam modulated by digital signals; the electrostatic latent image was developed with a dual component type developer comprising nonmagnetic toner having an average particle-size of 5 μm and resin-coated ferrite carrier having an average particle-size of 20 μm, in a contact-reversal developing method, in the state where a DC 500 V was applied to the development gap; and the developed image was transferred to a sheet of plain paper and the transferred image was then fixed.

In the repetition of the process, the light amount in the dot exposures for writing in both of the solid image portion and the character image portion was so controlled as to be larger in the solid image portion than in the character image portion —Example II-1—. The light amount was increased by raising the voltage applied to the semiconductor laser so as to intensify the light intensity. Or otherwise, such a control can also performed by setting a pulse width to be wider in the solid image portions than in the line image portions as in a pulse width modulation control, —PWM—.

In the above-described process, an image was formed with a copier, the remodeled DC-8010 copier, by switching the writing light amount over to 2 $mW/cm^2$ in the character image portion and to 4 $mW/cm^2$ in the solid image portion. For the comparative examples, the light amount was kept constant in every portion in one example, and it was switched over to 2 $mW/cm^2$ in Comparative Example II-1; and it was switches over to 4 $mW/cm^2$ in Comparative Example II-2. And, every results were evaluated.

The measurement results thereof were as shown in Table II-1. Each of the measuring methods were as follows:

Resolving power: Thin-lines were drawn at 400 dpi with the intervals of every 2 dots and the resulting image was evaluated with a Sakura Microdensitometer Model PDM-5 manufactured by Konica Corp. When the white background between the thin-line had a density of not higher than 5% of each of the thin-line densities, the evaluation thereof were expressed by Resolving power recognizable; and, when it is not lower than 5%, the evaluation thereof were expressed by 'Resolving power not recognizable.

Image density : The measurements thereof were made with Sakura Reflection Densitometer manufactured by Konica Corp.

TABLE II-1

| | Reproducibility of thin lines in character image portion (at 400 dpi and 2-dots intervals) | Solid black image density in solid image portion (relative value) |
|---|---|---|
| Inventive Example II-1 | Resolving power recognizable | 1.3 |
| Comparative Example II-1 | Resolving power recognizable | 1.0 |
| Comparative Example II-2 | Resolving power not recognizable | 1.3 |

From the table above, it can be found that, in the method based on the invention, the density in the solid image portions were improved to be compatible with the character image portions so that an excellent quality image could be obtained.

EXAMPLE II-2

To the solid image portions of Example II-1, the PWM controlling time for pulse width in a dot-exposure operation was set to be 1,5 times as much as the time required for the character image portions, that is to say, it was 2.0 dots-controlled at 400 dpi relative to an ordinary 1 dot-control at 400 dpi. At that time, the thin-line resolving power and the density in the solid image portions were measured. The results thereof were excellent as shown in Table II-2.

TABLE II-2

| | Thin-line reproducibility in character image portions | Density in solid-image portion |
|---|---|---|
| Inventive Example II-2 | Resolving power recognizable | 1.3 |

In the invention, as described above, the necessary exposure amount can be given to every image portion so that the density in the solid image portion can be sufficient and the resolving power of the thin-line portion can also be excellent, because the dot-light amount given to the solid image portions was made larger than that given to the thin-line portion when charging and exposing a photoreceptor showing a maximum value of the differential coefficient to the light amount on a light decay curve.

EMBODIMENT [III]

An embodiment capable of achieving the third object of the invention will now be detailed.

First, the photoreceptive substances applicable to the photoreceptive layers of the photoreceptor used in this embodiment will be detailed. When using a semiconductor laser beam as a beam for exposure, the suitable photoconductive organic pigments may be used. They include, particularly, the titanyl phthalocyanine pigments such as those described in Japanese Patent O.P.I. Publication Nos. 109056/1986 and 217050/1986; the X-type nonmetallic phthalocyanine pigments such as those described in Japanese Patent Examined Publication No. 4338/1974; the $\tau$-type nonmetallic phthalocyanine pigments such as those described in Japanese Patent O.P.I. Publication No. 183757/1983; the $\epsilon$-type copper phthalocyanine pigments such as those described in Japanese Patent O.P.I. Publication No. 1662/1977; the $\beta$-type nonmetallic phthalocyanine pigments such as those described in Japanese Patent O.P.I. Publication No. 59468/1980; and, besides, the Y- and $\alpha$-types of titanium phthalocyanine pigments. It is also allowed to add, in combination therewith, in a small amount of the bisazo, trisazo, tetrazo and polycyclic quinone pigments such as those described in Japanese Patent O.P.I. Publication No. 14157/1987; the azulenium salt pigments such as those described in Japanese Patent O.P.I. Publication No. 15147/1986; the trisazo pigments such as those described in Japanese Patent O.P.I. Publication Nos. 205746/1982, 205747/1982 and 206658/1982; and the squarelium pigments such as those described in Japanese Patent O.P.I. Publication No. 105536/1974.

Further, in the antioxidants having a hindered phenol structure unit, which may be used in a photoreceptive layer, the term, 'hindered phenol structure unit', is characterized in that atomic groups of a large mass are present in the ortho position of the phenolic hydroxyl group or the alkoxy group thereof.

As for the atomic groups of a large mass mentioned above, branched alkyl groups are generally convenient.

The functional mechanism of the effect has not been cleared yet. It may however be presumed that the thermal vibration of the phenolic hydroxyl group or the alkoxy group may be inhibited, or the influence of the external active substances may be hindered, by the steric hindrance produced by the atomic groups of a large mass.

The preferable hindered phenol structure units include those represented by the following formula [I]:

Formula [I]

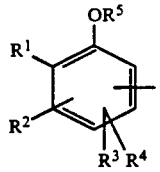

wherein $R^1$ represents a branched alkyl group; $R^2$, $R^3$ and $R^4$ represent each a hydrogen atom, a hydroxy group, an alkyl group or an aryl group, and, at least two of $R^2$, $R^3$ and $R^4$ are allowed to couple to each other so as to form a ring; and $R^5$ represents a hydrogen atom, an alkyl group or an alkylidene group.

In the above-given formula, $R^1$ is preferable to be a tert- or sec-alkyl group having 3 to 40 carbon atoms.

The alkyl groups for $R^2$, $R^3$ and $R^4$ are preferable to have 1 to 40 carbon atoms, and the aryl groups for them include, preferably, a phenyl, naphthyl and pyridyl groups. In the cases where $R^2$ and $R^3$ form a ring, the rings include, preferably, a chroman ring.

The alkyl and alkylidene groups each represented by $R^5$ include, desirably, those having 1 to 40 carbon atoms and, preferably, those having 1 to 18 carbon atoms.

Next, the typical examples of the compounds each having a hindered phenol structure unit, which can be applicable to this embodiment, —hereinafter referred to as the HP compounds—, will now be given below. It is, however, to be understood that the HP compounds shall not be limited thereto.

Exemplified compounds each having a hindered phenol structure unit:

HP-1

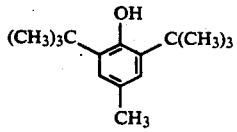

HP-2

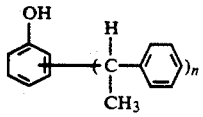

HP-3

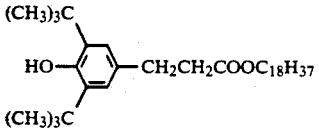

HP-4

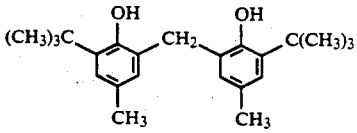

HP-5

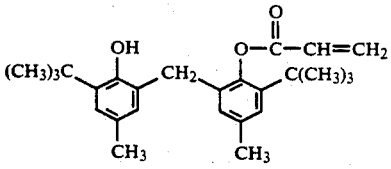

HP-6

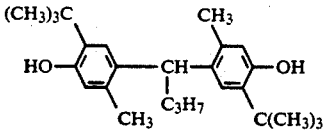

HP-7

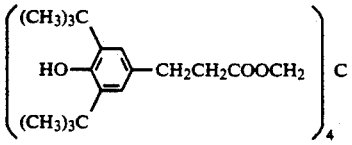

HP-8

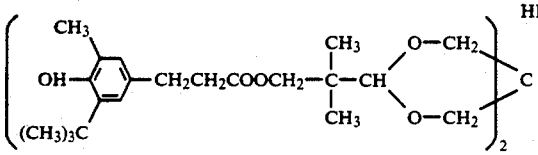

-continued

HP-9

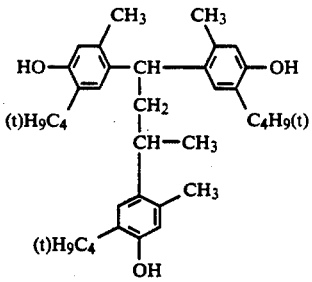

HP-10

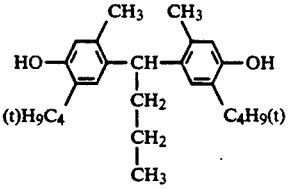

HP-11

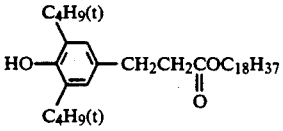

HP-12

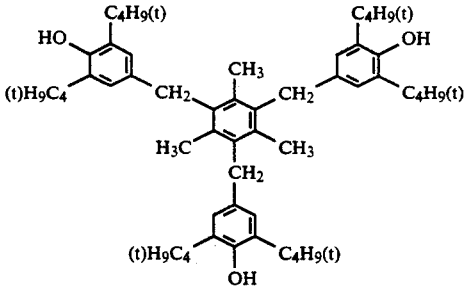

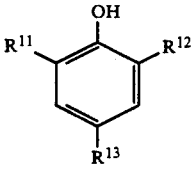

| Compound | $R^{11}$ | $R^{12}$ | $R^{13}$ |
|---|---|---|---|
| HP-13 | t-$C_4H_9$ | t-$C_4H_9$ | $C_4H_9$ |
| HP-14 | t-$C_4H_9$ | t-$C_4H_9$ | t-$C_4H_9$ |
| HP-15 | t-$C_4H_9$ | t-$C_4H_9$ | sec-$C_4H_9$ |
| HP-16 | t-$C_4H_9$ | t-$C_4H_9$ | $C_2H_5$ |
| HP-17 | t-$C_4H_9$ | $CH_3$ | $CH_3$ |
| HP-18 | t-$C_4H_9$ | $CH_3$ | t-$C_4H_9$ |
| HP-19 | t-$C_4H_9$ | $CH_3$ | $C_4H_9$ |
| HP-20 | t-$C_4H_9$ | $CH_3$ | sec-$C_4H_9$ |
| HP-21 | t-$C_4H_9$ | $CH_3$ | $C_2H_5$ |
| HP-22 | t-$C_4H_9$ | $C_2H_5$ | $C_4H_9$ |
| HP-23 | t-$C_4H_9$ | $C_2H_5$ | t-$C_4H_9$ |
| HP-24 | t-$C_4H_9$ | $C_2H_5$ | sec-$C_4H_9$ |
| HP-25 | t-$C_4H_9$ | $C_2H_5$ | $CH_3$ |
| HP-26 | t-$C_4H_9$ | $C_2H_5$ | $C_2H_5$ |
| HP-27 | $C_2H_5$ | $C_2H_5$ | sec-$C_4H_9$ |
| HP-28 | $C_2H_5$ | $C_2H_5$ | t-$C_4H_9$ |
| HP-29 | i-$C_4H_9$ | i-$C_4H_9$ | $CH_3$ |
| HP-30 | sec-$C_4H_9$ | sec-$C_4H_9$ | $C_3H_7$ |
| HP-31 | sec-$C_4H_9$ | sec-$C_4H_9$ | sec-$C_4H_9$ |

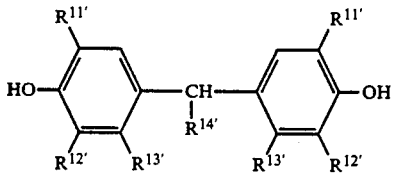

| Compound | $R^{11'}$ | $R^{12'}$ | $R^{13'}$ | $R^{14'}$ |
|---|---|---|---|---|
| HP-32 | $CH_3$ | H | H | H |
| HP-33 | $CH_3$ | $CH_3$ | H | H |
| HP-34 | $CH_3$ | t-$C_4H_9$ | H | H |
| HP-35 | t-$C_4H_9$ | t-$C_4H_9$ | H | H |
| HP-36 | t-$C_4H_9$ | H | H | $CH_3$ |
| HP-37 | $CH_3$ | H | H | t-$C_4H_9$ |
| HP-38 | H | $CH_3$ | $C_3H_7$ | $CH_3$ |
| HP-39 | t-$C_4H_9$ | H | $CH_3$ | H |
| HP-40 | $CH_3$ | H | $CH_3$ | $C_3H_7$ |
| HP-41 | t-$C_4H_9$ | H | $CH_3$ | $C_5H_{11}$ |
| HP-42 | $CH_3$ | $CH_3$ | H | $C_9H_{19}$ |
| HP-43 | $C_{12}H_{25}$ | $CH_3$ | H | H |

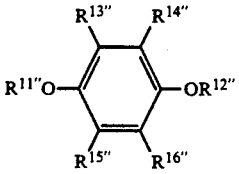

| Compound | $R^{11''}$ | $R^{12''}$ | $R^{13''}$~$R^{16''}$ |
|---|---|---|---|
| HP-44 | $C_7H_{15}$ | $C_7H_{15}$ | $R^{13''}$: $C_{12}H_{25}$(sec), $R^{16''}$: $CH_3$ |
| HP-45 | $C_{10}H_{21}$ | $C_{10}H_{21}$ | $R^{13''}$: $C_8H_{17}$(t), $R^{16''}$: $CH_3$ |
| HP-46 | $C_{20}H_{41}$ | $C_{20}H_{41}$ | $R^{13''}$: $C_4H_9$(t), $R^{16''}$: $CH_3$ |
| HP-47 | $C_4H_9$ | $C_4H_9$ | $R^{13''}$: $C_{12}H_{25}$(sec), $R^{16''}$: $CH_3$ |
| HP-48 | $C_4H_9$ | $C_4H_9$ | $R^{13''}$: $C_8H_{17}$(t), $R^{16''}$: $CH_3$ |
| HP-49 | $C_4H_9$ | $C_4H_9$ | $R^{13''}$: $C_4H_9$(t), $R^{16''}$: $CH_3$ |
| HP-50 | $C_8H_{17}$ | $C_8H_{17}$ | $R^{13''}$: $C_{18}H_{37}$(sec), $R^{16''}$: $CH_3$ |
| HP-51 | $C_8H_{17}$ | $C_8H_{17}$ | $R^{13''}$: $C_{18}H_{37}$(sec), $R^{16''}$: $CH_3$ |
| HP-52 | $C_8H_{17}$ | $C_8H_{17}$ | $R^{13''}$: $C_8H_{17}$(t), $R^{16''}$: $CH_3$ |
| HP-53 | $C_8H_{17}$ | $C_8H_{17}$ | $R^{13''}$: $C_4H_9$(t), $R^{16''}$: $CH_3$ |
| HP-54 | $C_{12}H_{25}$ | $C_{12}H_{25}$ | $R^{13''}$: $C_4H_9$(t), $R^{16''}$: $CH_3$ |
| HP-55 | $C_{12}H_{25}$ | $C_{12}H_{25}$ | $R^{13''}$: $C_8H_{17}$(t), $R^{16''}$: $CH_3$ |
| HP-56 | $C_{12}H_{25}$ | $C_{12}H_{25}$ | $R^{13''}$: $C_{12}H_{25}$(sec), $R^{16''}$: $CH_3$ |
| HP-57 | $C_{16}H_{33}$ | $C_{16}H_{33}$ | $R^{13''}$: $C_4H_9$(sec), $R^{16''}$: $CH_3$ |
| HP-58 | $C_{16}H_{33}$ | $C_{16}H_{33}$ | $R^{13''}$: $C_4H_9$(t), $R^{16''}$: $CH_3$ |
| HP-59 | $C_{16}H_{33}$ | $C_{16}H_{33}$ | $R^{13''}$: $C_{12}H_{25}$(sec), $R^{16''}$: $CH_3$ |
| HP-60 | $C_8H_{17}$ | $C_8H_{17}$ | $R^{13''}$: $CH_3$, $R^{15''}$: $CH_3$, $R^{16''}$: $CH_3$ |
| HP-61 | $C_{12}H_{25}$ | $C_{12}H_{25}$ | $R^{13''}$: $CH_3$, $R^{15''}$: $CH_3$, $R^{16''}$: $CH_3$ |
| HP-62 | $C_{16}H_{33}$ | $C_{16}H_{33}$ | $R^{13''}$: $CH_3$, $R^{15''}$: $CH_3$, $R^{16''}$: $CH_3$ |
| HP-63 | $CH_2CH{=}CH_2$ | $CH_2CH{=}CH_2$ | $R^{13''}$: $C_8H_{17}$(t), $R^{16''}$: $C_8H_{17}$(t) |
| HP-64 | $C_8H_{17}$ | $C_8H_{17}$ | $R^{13''}$: $C_4H_9$(t), $R^{16''}$: $C_4H_9$(t) |
| HP-65 | $C_8H_{17}$ | $C_8H_{17}$ | $R^{13''}$: $CH_2$—N O, $R^{16''}$: $CH_2$—N O |
| HP-66 | $C_{18}H_{33}$ | $C_{18}H_{33}$ | $R^{13''}$: $CH_2$—N O, $R^{16''}$: $CH_2$—N O |
| HP-67 | $C_{18}H_{37}$ | $C_{18}H_{37}$ | $R^{13''}$: $C_{12}H_{25}$, $R^{16''}$: $CH_3$ |
| HP-68 | $C_{16}H_{33}$ | $C_{16}H_{33}$ | $R^{13''}$: $C_{12}H_{25}$, $R^{16''}$: $C_{12}H_{25}$ |
| HP-69 | $C_{12}H_{25}$ | $C_{12}H_{25}$ | $R^{13''}$: $C_{16}H_{33}$(sec), $R^{16''}$: $C_{16}H_{33}$(sec) |
| HP-70 | $C_2H_5$ | $C_2H_5$ | $R^{13''}$: $(CH_2)_{11}OCH_3$, $R^{16''}$: $(CH_2)_{11}OCH_3$ |
| HP-71 | $C_4H_9$(t) | $C_4H_9$(t) | $R^{13''}$: $C_{11}H_{23}$, $R^{16''}$: $C_{11}H_{23}$ |
| HP-72 | $C_{18}H_{35}$ | $C_{18}H_{35}$ | $R^{13''}$: $C_{12}H_{25}$(sec), $R^{16''}$: $C_{12}H_{25}$(sec) |
| HP-73 | $CH_3$ | $(CH_2)_{10}Br$ | $R^{13''}$: $OCH_3$ |
| HP-74 | H | H | $R^{13''}$: $C_{16}H_{33}$, $R^{16''}$: $C_{16}H_{33}$ |

-continued

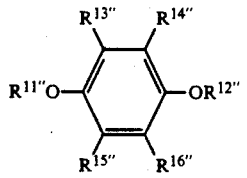

| Compound | $R^{11''}$ | $R^{12''}$ | $R^{13''}$~$R^{16''}$ |
|---|---|---|---|
| HP-75 | $C_8H_{17}$ | $C_8H_{17}$ | $R^{13''}$: 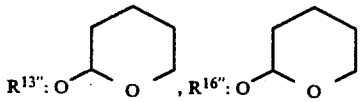 |
| HP-76 | | 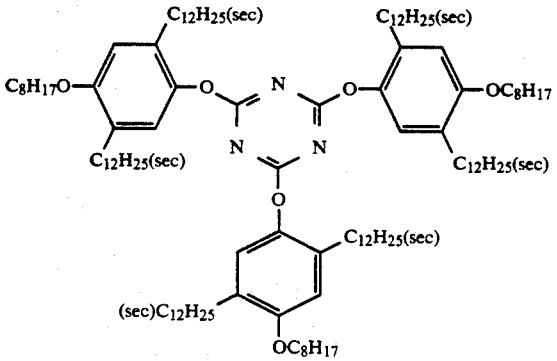 | |
| HP-77 | | 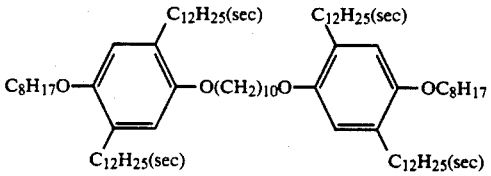 | |
| HP-78 | $C_3H_7$ (i) | $C_3H_7$ (i) | $R^{13''}$: $(CH_2)_{11}OCH_3$ |
| HP-79 | $C_{18}H_{37}$ | $C_{18}H_{37}$ | $R^{13''}$: $CH_2$— 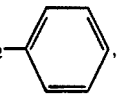 , $R^{16''}$: $CH_3$ |
| HP-80 | 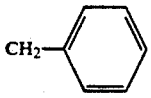 | 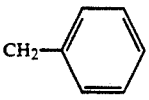 | $R^{13''}$: $C_{16}H_{33}$(sec), $R^{16''}$: $C_{16}H_{33}$(sec) |
| HP-81 | $C_{12}H_{25}$ | $C_{16}H_{33}$ | $R^{14''}$: $CH_3$ |
| HP-82 | $C_{18}H_{37}$ | $C_{18}H_{37}$ | $R^{14''}$: $CH_3$ |
| HP-83 | $C_4H_9$ | $C_4H_9$ | $R^{13}$↑: Cl, $R^{16''}$: Cl |
| HP-84 | $C_5H_{11}$(sec) | $C_5H_{11}$(sec) | $R^{14''}$: $N(CH_2CH_2OH)_2$ |
| HP-85 | $C_3H_7$(i) | 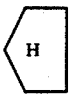 | $R^{13''}$: $C_8H_{17}$(t), $R^{16''}$: $CH_3$ |
| HP-86 | $C_7H_{15}$(sec) | $C_7H_{15}$(sec) | $R^{13''}$: $CH_2CO_2C_2H_5$, $R^{16''}$: $CH_2CO_2C_2H_5$ |
| HP-87 | $C_8H_{17}$ | $C_8H_{17}$ | $R^{13''}$: $COCH_3$ |
| HP-88 | $C_{16}H_{33}$ | $C_{16}H_{33}$ | $R^{13''}$: $COC_{11}H_{23}$ |
| HP-89 | $C_{12}H_{25}$(sec) | $C_{12}H_{25}$(sec) | $R^{13''}$: $CO_2C_2H_5$ |
| HP-90 | $C_{16}H_{33}$ | $C_{16}H_{33}$ | $R^{13''}$: $OC_2H_5$, $R^{16''}$: $OC_2H_5$ |
| HP-91 | $CH_2CO_2C_2H_5$ | $CH_2CO_2C_2H_5$ | $R^{13''}$: $C_4H_9$(t), $R^{16''}$: $C_4H_9$(t) |
| HP-92 | $CH_2CO_2C_2H_5$<br>\|<br>$C_{12}H_{25}$ | $C_3H_7$ | $R^{13''}$: $C_4H_9$(t), $R^{16''}$: $CH_3$ |

-continued

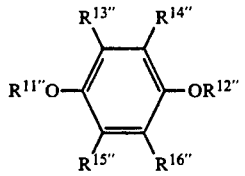

| Compound | $R^{11''}$ | $R^{12''}$ | $R^{13''}$~$R^{16''}$ |
|---|---|---|---|
| HP-93 | $C_2H_5$ | $CH_2CH_2$— | $R^{13''}$: $NHCOCH_3$ |
| HP-94 | $C_{12}H_{25}$ | $C_{12}H_{25}$ | $R^{13''}$: $C_4H_9(t)$, $R^{16''}$: $C_4H_9(t)$ |
| HP-95 | $C_8H_{17}$ | $C_8H_{17}$ | $R^{13''}$: $C_8H_{17}(t)$, $R^{16''}$: $C_8H_{17}(t)$ |
| HP-96 | $C_2H_5$ | $C_2H_5$ | $R^{13''}$: $C_6H_{13}(t)$, $R^{16''}$: $C_6H_{13}(t)$ |
| HP-97 | $CH_3$ | $CH_3$ | $R^{13''}$: $C_4H_9(t)$, $R^{16''}$: $C_4H_9(t)$ |
| HP-98 | $C_4H_9$ | $C_4H_9$ | $R^{13''}$: $C_4H_9(t)$, $R^{16''}$: $C_4H_9(t)$ |
| HP-99 | $CH_2$— | $CH_2$— | $R^{13''}$: $C_4H_9(t)$, $R^{16''}$: $C_4H_9(t)$ |
| HP-100 | $C_{18}H_{37}$ | $C_{18}H_{37}$ | $R^{13''}$: $C_4H_9(t)$, $R^{16''}$: $C_4H_9(t)$ |
| HP-101 | $C_{16}H_{33}$ | $C_{16}H_{33}$ | $R^{13''}$: $C_4H_9(t)$, $R^{16''}$: $C_4H_9(t)$ |
| HP-102 | $CH_2CH_2$— | $CH_2CH_2$— | $R^{13''}$: $C_4H_9(t)$, $R^{16''}$: $C_4H_9(t)$ |
| HP-103 | $C_4H_9$ | $C_4H_9$ | $R^{13''}$: $C_5H_{11}(t)$, $R^{16''}$: $C_5H_{11}(t)$ |
| HP-104 | $C_2H_5$ | $C_2H_5$ | $R^{13''}$: $C_5H_{11}(t)$, $R^{16''}$: $C_5H_{11}(t)$ |
| HP-105 | $C_3H_7$ | $C_3H_7$ | $R^{13''}$: $C_5H_{11}(t)$, $R^{16''}$: $C_5H_{11}(t)$ |
| HP-106 | $CH_3$ | $CH_3$ | $R^{13''}$: $C_5H_{11}(t)$, $R^{16''}$: $C_5H_{11}(t)$ |
| HP-107 | $CH_2$— | $CH_2$— | $R^{13''}$: $C_5H_{11}(t)$, $R^{16''}$: $C_5H_{11}(t)$ |
| HP-108 | $CH_3$ | $CH_3$ | $R^{13''}$: $C_6H_{13}(t)$, $R^{16''}$: $C_6H_{13}(t)$ |
| HP-109 | $C_3H_7$ | $C_3H_7$ | $R^{13''}$: $C_6H_{13}(t)$, $R^{16''}$: $C_6H_{13}(t)$ |
| HP-110 | $C_4H_9$ | $C_4H_9$ | $R^{13''}$: $C_6H_{13}(t)$, $R^{16''}$: $C_6H_{13}(t)$ |
| HP-111 | $CH_2$— | $CH_2$— | $R^{13''}$: $C_6H_{13}(t)$, $R^{16''}$: $C_6H_{13}(t)$ |
| HP-112 | $CH_3$ | $CH_3$ | $R^{13''}$: $C_8H_{17}(t)$, $R^{16''}$: $C_8H_{17}(t)$ |
| HP-113 | $C_2H_5$ | $C_2H_5$ | $R^{13''}$: $C_8H_{17}(t)$, $R^{16''}$: $C_8H_{17}(t)$ |
| HP-114 | $C_3H_7$ | $C_3H_7$ | $R^{13''}$: $C_8H_{17}(t)$, $R^{16''}$: $C_8H_{17}(t)$ |
| HP-115 | $C_4H_9$ | $C_4H_9$ | $R^{13''}$: $C_8H_{17}(t)$, $R^{16''}$: $C_8H_{17}(t)$ |
| HP-116 | $CH_2$— | $CH_2$— | $R^{13''}$: $C_8H_{17}(t)$, $R^{16''}$: $C_8H_{17}(t)$ |
| HP-117 | $CH_3$ | $CH_3$ | $R^{13''}$: $C_{12}H_{25}(t)$, $R^{16''}$: $C_{12}H_{25}(t)$ |
| HP-118 | $C_2H_5$ | $C_2H_5$ | $R^{13''}$: $C_{12}H_{25}(t)$, $R^{16''}$: $C_{12}H_{25}(t)$ |
| HP-119 | $C_3H_7$ | $C_3H_7$ | $R^{13''}$: $C_{12}H_{25}(t)$, $R^{16''}$: $C_{12}H_{25}(t)$ |
| HP-120 | $C_4H_9$ | $C_4H_9$ | $R^{13''}$: $C_{12}H_{25}(t)$, $R^{16''}$: $C_{12}H_{25}(t)$ |
| HP-121 | $CH_2$— | $CH_2$— | $R^{13''}$: $C_{12}H_{25}(t)$, $R^{16''}$: $C_{12}H_{25}(t)$ |

The electron-receptive substances applicable to this embodiment are essential to provide a sufficient photoreceptivity to photoreceptors. Such substances include, for example, chloranil, 2,6-dichloro-p-benzoquinone, 2,5-dinitro-9-fluorenone, 2,3-dichloro-5,6-dicyano-p-benzoquinone. p-benzoquinone, p-dinitrobenzene, tetrafluorosuccinic acid anhydride, tetrafluoro-p-benzoquinone, tetrabromo-p-benzoquinone, 2,6-dinitro-9-fluorenone, 2,4,7-trinitrofluorenone, 2,4,5,7-tetranitrofluorenone, m-dinitrobenzene, and hexafluoroglutamic acid anhydride.

The electron-acceptive substances are to have an electron affinity within the range of, desirably, 0.5 to 3.0 eV and, preferably, 0.8 to 2.9 eV.

In this embodiment, the proportions by weight of the foregoing antioxidants —HP compounds— and the electron-acceptive substances to the foregoing phthalocyanine pigments are inevitable to be as follows:

$$0.1 \leqq \frac{\text{Antioxidant}}{\text{Phthalocyanine pigment}} \times 100 < 50$$

$$0.1 \leqq \frac{\text{Electron-acceptive substance}}{\text{Phthalocyanine pigment}} \times 100 < 40$$

In other words, if the proportion of the HP compound to the phthalocyanine pigment is less than 0.1, the $V_H$ value thereof is seriously lowered even in the order of 100 copy cycles, because the proportion is too small. If the proportion is not less than 50, the photosensitivity is lowered instead, because the proportion is too large. The either cases are not unsuitable. Therefore, the proportion is to be within the range of, desirably, 0.5 to 40 and, preferably, 1.0 to 30. If the proportion of the electon-acceptive substances to the phthalocyanine pigments are less than 0.1, the photosensitivity is lowered, because the proportion is too low. If it is not lower than 40, the charging potential is lowered, because the proportion is too high instead. Therefore, the proportion is to be within the range of, desirably, 0.5 to 30 and, preferably, 1.0 to 25.

It is advisable that the proportion of the phthalocyanine pigments themselves to a resin content of a photoreceptive layer is to be within the range of, desirably, 5 to 200% by weight and, preferably, 10 to 100% by weight.

In the photoreceptive layer, each of the above-mentioned components is dispersed in the binder resins. The suitable resins contained in the photoreceptive layer include, for example, melamine resin, polyester resin, silicone resin, urea resin, phenol resin, epoxy resin, alkyd resin, polyimide resin and urethane resin. These resins may be used independently or in combination, and the copolymers thereof may also be used for. The desirable combinations thereof include, for example, those of the silicone-melamine type or the polyester-melamine type. Such thermosetting resins are advantageous to maintain the durability of photoreceptive layers, because they are stable and strong in binding capacity.

FIG. 3-*a* exemplifies a photoreceptor embodied in the invention. In the figure, 41 is a conductive support, 42 is an interlayer provided as required, and 43 is a photoreceptive layer.

Photoreceptive layer 43 is formed in the following manner: A coating solution is prepared by mixing and dispersing, into solvent for binder resin, the foregoing phthalocyanine pigment, the binder resin, the antioxidant —the HP compound—, and the electron-acceptive substance so as to be in the form of fine despersion having a size within the range of 0.1 to 1 μm; the resulting coating slurry is coated on interlayer 42 and is the dried; and, if required, a heat treatment is applied thereto.

Interlayer 42 functions as an adhesive layer or a barrier layer. Besides the above-given binder resins, the following materials are included, for example, polyvinyl alcohol, ethyl cellulose, carboxymethyl cellulose, a vinyl chloride-vinyl acetate copolymer, a vinyl chloride-vinyl acetate-maleic anhydride copolymer, casein, N-alkoxymethylated nylon, and starch.

The materials for forming conductive support 41 include, for example, metal plates or drums, such as those of aluminium, steel or copper. In addition, a sheet of paper or plastic film, on which a metal layer is laminated or vacuum evaporated, may also be used for.

In such a photoreceptor as shown in FIG. 3-*a*, none of carrier-transport material —CTM— may not be contained in photoreceptive layer 43. In this case, the photoreceptors becomes the one which has the high γ-type light-decay characteristics such as those shown in FIGS. 6-A and 7. It may be also allowed to contain CTM, however, the upper limit of the CTM content is desirably in a proportion of 20 parts by weight to 100 parts by weight of the binder resin to be used.

The thickness of photoreceptive layer 43 is within the range of, desirably, the order of 5 to 200 μm and, preferably, 10 to 100 μm. If the thickness thereof is too thin, a high electrostatic chargeability can hardly be obtained, and a high gamma property which caused by avalanche phenomenon can also hardly be obtained. If the thickness thereof is too thick, on the other hand, the light-decay characteristics has a substantially longer skirt and, resultingly, a dot-image having a high sharpness can hardly be obtained.

FIGS. 3-*b* and 3-*c* show each the other photoreceptors derived from this embodiment. FIG. 3-*b* shows a photoreceptor comprising photoreceptive layer 43 having a laminated-layer structure in which support 41 is provided thereonto with charge transport layer 53 as the upper layer and charge generative layer 52 as the lower layer; and FIG. 3-*c* shows another type of photoreceptive layer in which layers 53 and 52 shown in FIG. 3-*b* are provided upside down; incidentally 52 is a phthalocyanine pigment which serves as the charge generating material and 53 is a carrier transport material.

In the cases of the above-described laminated structures, the thickness of charge generating layer 52 is within the range of, desirably, 1 to 20 μm and, preferably, 2 to 10 μm. If the thickness is too thick, a residual charge ramains and, if it is too thin, there may be some tendencies to show none of any ON·OFF characteristics.

It is further allowed to provide a protective layer over the surface of the photoreceptors shown in FIGS. 3-*a* and 3-*b*.

There is no special limitation to the carrier transport materials applicable to the above-mentioned photoreceptors. For example, they include, without limitation, an oxazole derivative, an axadiazole derivative, a thiazole derivative, a thiadiazole derivative, a triazole derivative, an imidazole derivative, an indazolone derivative, an imidazolizine derivative, a bisimidazolizine derivative, a styryl compound, a hydrazone compound, a pyrazoline derivative, an oxazolone derivative, a benzothiazole derivative, a benzimidazole derivative, a quinazoline derivative, a benzofuran derivative, an acridine derivative, a phenazine derivative, an aminostilbene derivative, poly-N-vinyl carbazole, poly-1-vinyl pyrene, and poly-9-vinyl anthracene.

Carrier transport layer 53 is to be formed to have a thickness within the range of, desirably, 2 to 50 μm and, preferably, 2 to 30 μm. The binder resins applicable to the layer include the following resins as well as the above-given thermosetting resins; namely, the thermoplastic resins such as polypropylene, acryl resin, methacryl resin, vinyl chloride resin, vinyl acetate resin, epoxy resin, butyral resin, polycarbonate resin, silicone resin, or the copolymeric resins thereof, e.g., vinyl chloride-vinyl acetate copolymeric resin, vinyl chloride-vinyl acetate-maleic anhydride copolymer resin, and the organic polymer semiconductor such as poly-N-vinyl carbazole; and, besides, any one of thermoplastic resins applicable to electrophotographic materials can also be utilized for.

In addition, it is also allowed to make silicone oil present as a surface modifier and to contain an ammonium compound as a durability improver.

The photoreceptive layers shown in FIGS. 3-*b* and 3-*c* can be provided in either a method in which the foregoing phthalocyanine pigment is vacuum evaporated onto the foregoing support, or in another method in which the pthalocyanine pigment is dispersed independently or in combination with a suitable binder resin dissolved into a suitable solvent and the resulting slurry is coated onto the foregoing support and then dried up.

For dispersing the phthalocyanine pigment, a ball mill, a homomixer, a sand mill, a supersonic homogenizer or an attriter are used.

The solvents applicable to the photoreceptive layer formation include, for example, N,N-dimethylformamide, benzene, toluene, xylene, monochlorobenzene, 1,2-dichloroethane, dichloromethane, 1,1,2-trichloroethane, tetrahydrofuran, methylethyl ketone, ethyl acetate and butyl acetate.

EMBODIMENT [IV]

Some examples of this embodiment will now be detailed. It is, however, to be understood that the embodiment shall not be limited to the following examples.

EXAMPLES IV-1 TO IV-6, AND Comparative Examples IV-1 to IV-14

For preparing the electrophotographic photoreceptor shown in FIG. 3-*a*, each of the following components of the compositions was prepared.

Polymer

Polyester: ALUMATEX P-645 made by Mitsui-Toatsu Chemical Co.;

Melamine resin: UVAN 21R made by the same Co. as above;

Polycarbonate: IUPILON Z-200 made by Mitsubishi Gas-Chemical Co.; and

Phenol resin: Ply-o-Phen 5592 made by Dai-Nippon Ink Co.

Epoxy resin: EPOKEY 803 made by Mitsui-toatsu Chemical Co.

Butylal resin: S-LEC BL-1 made by Sekisui-Chemical Ind. Co.

Phthalocyanine (Pc)

X-$H_2$Pc(X-type metal-free phthalocyanine): fastogen blue 8120 made by Dai-Nippon Ink Co.;

ε-CuPc(ε-type copper phthalocyanine):, and

τ-$H_2$Pc(τ-type metal-free phthalocyanine): Liophoton TPH-278 made by Toyo Ink Co.

Hindered Phenol Compounds (1) Sumilizer BP-76 made by Sumitomo Chemical Co.;
(2) Irganox 259 made by Ciba Geigy AG.;
(3) Irganox 1010 made by the same Co. as above; and
(4) Mark AO-30 made by AdekaArgus Chemical Co.

Electron-Acceptive Materials (1) Chloranil made by Kanto Chemical Co.;
(2) 2,3-dichloro-5,6-dicyano-p-benzoquinone made by the same Co. as above; and
(3) p-dinitrobenzene made by the same Co. as above.

Next, the following compositions were prepared.

| | |
|---|---|
| Phthalocyanine pigment<br>See the exemplifications thereof shown in TABLE IV-1; | 20 g |
| Hindered phenol compound<br>For the details of the amounts added, refer to TABLES IV-1 and IV-2 and for the exemplification, refer to TABLES IV-1 and IV-2; | |
| Electron-donative material<br>For the details of the amounts added, refer to TABLES IV-1 and IV-2 and the exemplifications thereof are shown in TABLES IV-1 and IV-2; | |
| Polymer (Binder resin)<br>See the exemplifications thereof shown in TABLES IV-1 and IV-2; | 107 g |
| Flow-controller, (Resimix RL-4 made by Mitsui-Toatsu Co.) | 2 g; and |
| Tetrahydrofuran | 400 g |

The resulting composition was dispersed for 3 hours with a sand grinder, so that a dispersion could be prepared. The glass beads having a particle-size within the range of 2.4 to 4.0 mm, Hi-Bead No. 8 made by Ohara Co., were used.

An aluminum drum having a diameter of 150 mm was dip-coated thereon with the dispersion and was then dried at a temperature of 150° C. for one hour, so that a 19 μm thick photoreceptive layer could be formed. In the same manner, the photoreceptors were prepared in the prescriptions shown in Tables IV-1 and IV-2. The resulting photoreceptors each displayed the high γ characteristics as shown in FIGS. 6-B and 7.

TABLE IV-1

| | Polymer | Type of Phthalocyanine pigment | Phthalocyanine pigment in 100 parts by wt. Hindered phenol compound | Electron-donative material |
|---|---|---|---|---|
| Inventive Example IV-1 | Polyester resin/melamine resin = 67/40 | X-$H_2$Pc | 0.1 wt parts (1)* | 0.1 wt parts (1) |
| Inventive Example IV-2 | Polyester resin/melamine resin = 67/40 | X-$H_2$Pc | 0.1 wt parts (2) | 39 wt parts (1) |
| Inventive Example IV-3 | Polyester resin/melamine resin = 67/40 | X-$H_2$Pc | 45 wt parts (3) | 0.1 wt parts (1) |
| Inventive Example IV-4 | Polyester resin/melamine resin = 67/40 | X-$H_2$Pc | 45 wt parts (4) | 38 wt parts (1) |
| Inventive Example IV-5 | Epoxy resin/ melamine resin | τ-$H_2$Pc | 0.1 wt parts (1) | 15 wt parts (1) |
| Inventive Example IV-6 | Epoxy resin/ melamine resin | τ-$H_2$Pc | 20 wt parts (2) | 0.1 wt parts (2) |
| Inventive Example | Epoxy resin/ melamine resin | τ-$H_2$Pc | 5 wt parts (3) | 20 wt parts (3) |

TABLE IV-1-continued

| | Polymer | Type of Phthalocyanine pigment | Phthalocyanine pigment in 100 parts by wt. Hindered phenol compound | Electron-donative material |
|---|---|---|---|---|
| IV-7 | | | | |
| Inventive Example IV-8 | Phenol resin | ε-CuPc | 15 wt parts (4) | 38 wt parts (1) |
| Inventive Example IV-9 | Phenol resin | ε-CuPc | 45 wt parts (1) | 20 wt parts (2) |
| Inventive Example IV-10 | Polyester resin/melamine resin = 67/40 | X-$H_2$Pc | 49 wt parts (1) | 0.1 wt parts (1) |
| Inventive Example IV-11 | Polyester resin/melamine resin = 67/40 | X-$H_2$Pc | 49 wt parts (1) | 39 wt parts (1) |
| Inventive Example IV-12 | Polyester resin/melamine resin = 67/40 | X-$H_2$Pc | 0.1 wt parts (1) | 10 wt parts (1) |
| Inventive Example IV-13 | Polyester resin/melamine resin = 67/40 | X-$H_2$Pc | 49 wt parts (1) | 10 wt parts (1) |
| Inventive Example IV-14 | Polyester resin/melamine resin = 67/40 | X-$H_2$Pc | 10 wt parts (1) | 0.1 wt parts (1) |
| Inventive Example IV-15 | Polyester resin/melamine resin = 67/40 | X-$H_2$Pc | 10 wt parts (1) | 39 wt parts (1) |
| Inventive Example IV-16 | Polyester resin/melamine resin = 67/40 | X-$H_2$Pc | 10 wt parts (1) | 10 wt parts (1) |

*Numeral enclosed by parentheses represents compound No. or material No..

TABLE IV-2

| | Polymer | Type of Phthalocyanine pigment | Phthalocyanine pigment in 100 parts by wt. Hindered phenol compound | Electron-donative material |
|---|---|---|---|---|
| Comparative Example IV-1 | Phenol resin/melamine resin = 67/40 | X-$H_2$Pc | 10 wt parts (1) | 40 wt parts (2) |
| Comparative Example IV-2 | Phenol resin/melamine resin = 67/40 | X-$H_2$Pc | 50 wt parts (2) | 40 wt parts (2) |
| Comparative Example IV-3 | Phenol resin/melamine resin = 67/40 | X-$H_2$Pc | 50 wt parts (3) | 10 wt parts (2) |
| Comparative Example IV-4 | Butyral resin/melamine resin | ε-CuPc | 0.05 wt parts (4) | 30 wt parts (2) |
| Comparative Example IV-5 | Butyral resin/melamine resin | ε-CuPc | 20 wt parts (1) | 0.05 wt parts (2) |
| Comparative Example IV-6 | Butyral resin/melamine resin | ε-CuPc | 0.05 wt parts (2) | 0.05 wt parts (1) |
| Comparative Example IV-7 | Butyral resin/melamine resin | τ-$H_2$Pc | 50 wt parts (3) | 0.05 wt parts (1) |
| Comparative Example IV-8 | Butyral resin/melamine resin | τ-$H_2$Pc | 0.05 wt parts (4) | 40 wt parts (1) |
| Comparative Example IV-9 | Phenol resin/melamine resin = 67/40 | X-$H_2$Pc | 0.05 wt parts (1) | 10 wt parts (1) |
| Comparative Example IV-10 | Phenol resin/melamine resin = 67/40 | X-$H_2$Pc | 50 wt parts (1) | 10 wt parts (1) |
| Comparative Example IV-11 | Phenol resin/melamine resin = 67/40 | X-$H_2$Pc | 10 wt parts (1) | 0.05 wt parts (1) |
| Comparative Example IV-12 | Phenol resin/melamine resin = 67/40 | X-$H_2$Pc | 0.05 wt parts (1) | 0.05 wt parts (1) |
| Comparative Example IV-13 | Phenol resin/melamine resin = 67/40 | X-$H_2$Pc | 0.05 wt parts (1) | 40 wt parts (1) |
| Comparative Example IV-14 | Phenol resin/melamine resin = 67/40 | X-$H_2$Pc | 50 wt parts (1) | 0.05 wt parts (1) |

TABLE IV-2-continued

The photoreceptors prepared as above were each loaded respectively on a copier, Remodeled DC-8100 manufactured by Konica Corp. and, the laser-ON potentials $V_L$ and lase-OFF potentials $V_H$ were measured in the black-developing region of the copier, in the first cycle and the 100th cycle from the start of their copying operations. In addition, each of the developed image was also evaluated.

The results thereof are shown in Tables IV-3 and IV-4.

TABLE IV-3

| | In the 1st copy cycle | | | In the 100th copy cycle | | |
|---|---|---|---|---|---|---|
| | $V_H$ (V) | $V_L$ (V) | Image | $V_H$ (V) | $V_L$ (V) | Image |
| Inventive Example IV-1 | +700 | +120 | Excellent | +690 | +100 | Excellent |
| Inventive Example IV-2 | +680 | +90 | Excellent | +670 | +80 | Excellent |
| Inventive Example IV-3 | +700 | +120 | Excellent | +690 | +110 | Excellent |
| Inventive Example IV-4 | +690 | +130 | Excellent | +690 | +120 | Excellent |
| Inventive Example IV-5 | +680 | +100 | Excellent | +680 | +90 | Excellent |
| Inventive Example IV-6 | +710 | +110 | Excellent | +710 | +100 | Excellent |
| Inventive Example IV-7 | +690 | +120 | Excellent | +680 | +110 | Excellent |
| Inventive Example IV-8 | +680 | +140 | Excellent | +680 | +120 | Excellent |
| Inventive Example IV-9 | +700 | +130 | Excellent | +700 | +120 | Excellent |
| Inventive Example IV-10 | +700 | +110 | Excellent | +690 | +110 | Excellent |
| Inventive Example IV-11 | +680 | +130 | Excellent | +680 | +120 | Excellent |
| Inventive Example IV-12 | +700 | +110 | Excellent | +670 | +100 | Excellent |
| Inventive Example IV-13 | +700 | +140 | Excellent | +700 | +120 | Excellent |
| Inventive Example IV-14 | +700 | +140 | Excellent | +700 | +130 | Excellent |
| Inventive Example IV-15 | +680 | +120 | Excellent | +680 | +110 | Excellent |
| Inventive Example IV-16 | +700 | +110 | Excellent | +700 | +110 | Excellent |

TABLE IV-4

| | In the 1st copy cycle | | | In the 100th copy cycle | | |
|---|---|---|---|---|---|---|
| | $V_H$ (V) | $V_L$ (V) | Image | $V_H$ (V) | $V_L$ (V) | Image |
| Comparative Example IV-1 | +650 | +110 | Partially fogged | +600 | +90 | Fogged |
| Comparative Example IV-2 | +660 | +190 | Thin-lines/ characters were sporadic | +650 | +180 | Fogged |
| Comparative Example IV-3 | +700 | +200 | Thin-lines/ characters were sporadic | +700 | +190 | Thin-characters were sporadic |
| Comparative Example IV-4 | +700 | +120 | Excellent | +640 | +110 | Fogged |
| Comparative Example IV-5 | +690 | +210 | Thin-lines/ characters were sporadic | +690 | +200 | Thin-lines/ characters were sporadic |
| Comparative Example IV-6 | +700 | +250 | Thin-lines/ characters were sporadic | +660 | +240 | Thin-lines/ characters were sporadic |
| Comparative Example IV-7 | +710 | +230 | Thin-lines/ characters were sporadic | +700 | +210 | Thin-lines/ characters were sporadic |
| Comparative Example IV-8 | +700 | +130 | Excellent | +640 | +110 | Fogged |
| Comparative Example IV-9 | +700 | +130 | Excellent | +640 | +110 | Fogged |
| Comparative Example IV-10 | +700 | +210 | Thin-lines/ characters were sporadic | +700 | +190 | Thin-lines/ characters were sporadic |
| Comparative Example IV-11 | +700 | +200 | Thin-lines/ characters were sporadic | +700 | +190 | Thin-lines/ characters were sporadic |
| Comparative Example IV-12 | +700 | +180 | Thin-lines/ characters were sporadic | +660 | +180 | Thin-lines/ characters were sporadic |
| Comparative Example IV-13 | +700 | +130 | Excellent | +640 | +110 | Fogged |
| Comparative Example IV-14 | +700 | +240 | Thin-lines/ character were sporadic | +700 | +230 | Thin-lines/ characters were sporadic |

EXAMPLES IV-17~IV-19 AND Comparative Examples IV-15~IV-16

A 7-μm thick charge generative layer was prepared by use of the dispersed slurry used in Example IV-1. On the upper layer thereof, a charge transport layer having the following composition was coated.

| | |
|---|---|
| Polycarbonate, IUPILON Z-200 made by Mitsubishi Gas-Chemical Co. | 100 parts by wt. |
| Styryl compound having the following chemical structure | 50 parts by wt. |

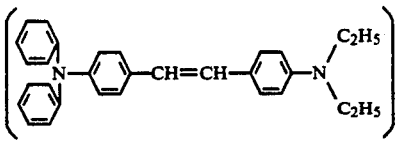

The layer thickness of the resulting charge transport layer was 15 μm. The resulting photoreceptor was named Example IV-17.

In the same manner, the photoreceptors shown in Table IV-5 below were prepared.

TABLE IV-5

| | Dispersion for the charge generating layer | Thickness of charge generating layer (μm) | Thickness of charge transport layer (μm) |
|---|---|---|---|
| Inventive Example IV-17 | (1)* | 7 | 15 |
| Inventive Example IV-18 | (1)* | 2 | 20 |
| Inventive Example IV-19 | (2)** | 10 | 10 |

*Dispersion for Example IV-1
**Dispersion for Example IV-5

For Comparative Examples IV-15 and IV-16, the dispersions were similarly prepared by use of the dispersion (3) used in Comparative Example IV-1. The charge transport layers thereof were the same as those in Examples IV-17 to IV-19.

TABLE IV-6

| | Dispersion for the charge generating layer | Thickness of charge generating layer (μm) | Thickness of charge transport layer (μm) |
|---|---|---|---|
| Comparative Example IV-15 | (3) | 7 | 15 |
| Comparative Example IV-16 | (3) | 2 | 10 |

EXAMPLES IV-20~IV-22 AND Comparative Examples IV-17~IV-18

As shown in the following Table IV-7, the photoreceptors were prepared by arranging the charge transport layers thereof to serve as the lower layer and the charge generating layer thereof as the upper layer, respectively, as shown in FIG. 3-c.

TABLE IV-7

| | Dispersion for the charge generating layer | Thickness of charge generating layer (μm) | Thickness of charge transport layer (μm) |
|---|---|---|---|
| Inventive Example IV-20 | (1) | 5 | 5 |
| Inventive Example IV-21 | (2) | 7 | 3 |
| Inventive Example IV-22 | (2) | 10 | 2 |
| Comparative Example IV-17 | (3) | 5 | 10 |
| Comparative | (3) | 15 | 10 |

TABLE IV-7-continued

| | Dispersion for the charge generating layer | Thickness of charge generating layer (μm) | Thickness of charge transport layer (μm) |
|---|---|---|---|
| Example IV-18 | | | |

INVENTIVE EXAMPLE IV-23

Polycarbonate resin, U-Pyron X-200, was coated on the surface of the photoreceptor of Inventive Example IV-1 so as to have a thickness of 2 μm. The resulting photoreceptor displayed the high γ characteristics such as those shown in FIGS. 6-B and 7.

The photoreceptor was evaluated upon loading it on a remodeled DC-8010 copier, and the results of the evaluation are shown in the following Table IV-8. Examples IV-17 to IV-19 and Comparative Examples IV-15 and IV-16 were each negatively charged, and Examples IV-20 to IV-23 and Comparative Examples IV-17 and IV-18 were each positively charged.

TABLE IV-8

| | In the 1st copy cycle | | | In the 100th copy cycle | | |
|---|---|---|---|---|---|---|
| | $V_H$ (V) | $V_L$ (V) | Image | $V_H$ (V) | $V_L$ (V) | Image |
| Inventive Example IV-17 | −700 | −120 | Excellent | −700 | −110 | Excellent |
| Inventive Example IV-18 | −700 | −110 | Excellent | −690 | −100 | Excellent |
| Inventive Example IV-19 | −700 | −100 | Excellent | −700 | −100 | Excellent |
| Inventive Example IV-20 | +700 | +120 | Excellent | +700 | +110 | Excellent |
| Inventive Example IV-21 | +690 | +90 | Excellent | +690 | +90 | Excellent |
| Inventive Example IV-22 | +700 | +90 | Excellent | +690 | +80 | Excellent |
| Inventive Example IV-23 | +700 | +90 | Excellent | +700 | +90 | Excellent |
| Comparative Example IV-15 | −700 | −120 | Partially fogged | −700 | −110 | Fogged |
| Comparative Example IV-16 | −660 | −110 | Partially fogged | −600 | −110 | Fogged |
| Comparative Example IV-17 | +650 | +120 | Partially fogged | +600 | +110 | Fogged |
| Comparative Example IV-18 | +660 | +120 | Partially fogged | +600 | +110 | Fogged |

As shown in the above table, in the every example based on the invention, both of the photosensitivity and potential stability could be excellent, so that the excellent images could be obtained and, in the comparative examples, the characters were sporadic and fogs were produced, so that none of the excellent images could be obtained.

As described above, in the photoreceptor of the invention having a maximum value of the differential coefficient to the light amount on the light-decay curve thereof, the potentials in repetition use can be stabilized and the initial photosensitivity can also be improved, because the weight proportions of an antioxidant content and an electron-donative material content each to the phthalocyanine pigment are provided to be the following proportions:

$$0.1 \leqq \frac{\text{Antioxidant}}{\text{Phthalocyanine pigment}} \times 100 < 50$$

$$0.1 \leqq \frac{\text{Electron-acceptive substance}}{\text{Phthalocyanine pigment}} \times 100 < 40$$

EMBODIMENT [V]

Next, an embodiment for achieving the fourth object of the invention will now be detailed.

The photoreceptor of this embodiment is constituted as shown by 11 in FIG. 2. In the figure, 41 is a conductive support, 42 is an interlayer and 43 is a photoreceptive layer.

Photoreceptive layer 43 is formed in such a manner that a coating slurry is prepared by mixing and dispersing a photoconductive organic pigment, a titanate type coupling agent, an electron-receptive material, a binder resin and, if required, adding an antioxidant so as to be in the form of fine particles having a particle-size within the range of 0.1 to 1 μm in the solvent for binder resin, and the resulting coating slurry is coated on interlayer 42, dried up and then, if required, heat treated.

The titanate type compound —having one of Formula A, B or C— is contained in photoreceptive layer 43. Such compounds include the exemplified compounds given next.

| No. | Chemical | Chemical structure | Trade name | Formula |
|---|---|---|---|---|
| 1 | Isopropyl tri-isostearoyl titanate | 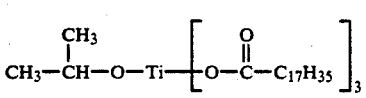 | Prene-Act TTS (2-3099) | A |
| 2 | Isopropyl tri-dodecyl-benzene-sulfonyl titanate | 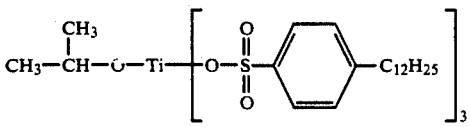 | Prene-Act 9S | A |

-continued

| No. | Chemical | Chemical structure | Trade name | Formula |
|---|---|---|---|---|
| 3 | Isopropyl tris(di-octylpyro-phosphate) titanate | $CH_3-CH(CH_3)-O-Ti-[O-P(=O)(OH)-O-P(=O)-(O-C_8H_{17})_2]_3$ | Prene-Act 38S | A |
| 4 | Tetraiso-propyl bix(dioctyl phosphite) titanate | $[CH_3-CH(CH_3)-O]_4-Ti.[P(-O-C_8H_{17})_2OH]_2$ | Prene-Act 41B (7-356, 2-1894) | C |
| 5 | Tetraoctyl bix(di-tridecyl phosphite) titanate | $(C_8H_{17}-O)_4Ti.[P(-O-C_{13}H_{27})_2OH]_2$ | Prene-Act 46B (7-356, 2-1894) | C |
| 6 | Tetra(2,2-diallyl-oxymethyl-1-butyl)bis (di-tridecyl) phosphite titanate | $[C_2H_5-C(CH_2-O-CH_2-CH=CH_2)_2-CH_2O]_4-Ti.[P(-O-C_{13}H_{27})_2OH]_2$ | Prene-Act 55 | C |
| 7 | Bis(dioctyl -pyrophos-phate)oxy-acetate titanate | 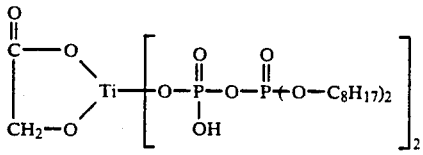 | Prene-Act 138S | B |
| 8 | Bis(dioctyl -pyrophos-phate ethylene titanate | 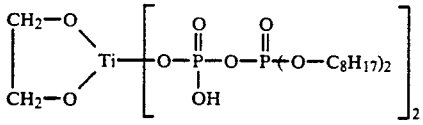 | Prene-Act 238S | B |
| 9 | Isopropyl-trioctanoyl titanate | $CH_3-CH(CH_3)-O-Ti-[O-C(=O)-C_7H_{15}]_3$ | Prene-Act KR 2S (2-3140) | A |
| 10 | Isopropyl-di-methacryl-isostearoyl titanate | 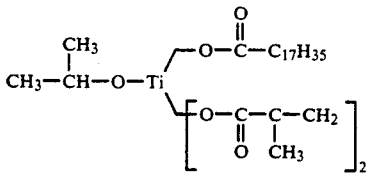 | Prene-Act KR 7 (2-3139) | A |
| 11 | Isopropyl isostearoyl diacryl titanate | 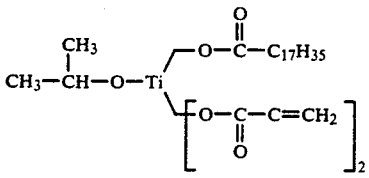 | Prene-Act KR 11 (2-3138) | A |
| 12 | Isopropyl tri(dioctyl phosphate) titanate | $CH_3-CH(CH_3)-O-Ti-[O-P(=O)(O-C_8H_{17})_2]_3$ | Prene-Act KR 12 | A |
| 13 | Isopropyl tricumyl-phenyl titanate | 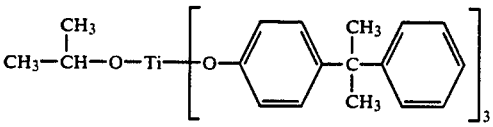 | Prene-Act Kr 34S | A |

-continued

| No. | Chemical | Chemical structure | Trade name | Formula |
|---|---|---|---|---|
| 14 | Isopropyl tri (N-aminoethyl-aminoethyl) titanate | $CH_3-\underset{\vert}{CH}(CH_3)-O-Ti[O-C_2H_4-NH-C_2H_4-NH_2]_3$ | Prene-Act KR 44 | A |
| 15 | Dicumyl-phenyl-oxyacetate titanate | 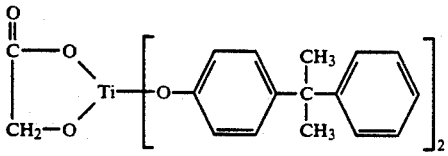 | Prene-Act 234S | B |
| 16 | Diisostea-royl-ethylene titanate | 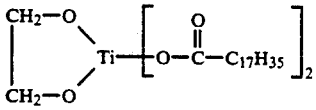 | Prene-Act KR 201 | B |
| 17 | Tri-isostearoyl titanate | $H-O-Ti[O-C(=O)-C_{17}H_{35}]_3$ | | A |
| 18 | Methacryl-tridodecyl-benzene sulfonyl titanate | 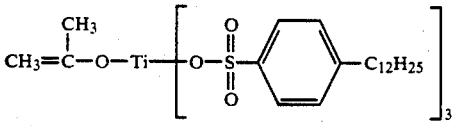 | | A |
| 19 | Isopropyl diacryl-isostearoyl titanate | 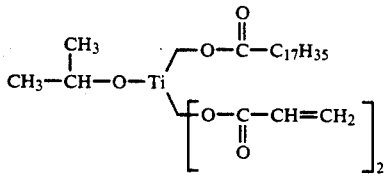 | | A |
| 20 | Isopropyl triphenyl titanate | 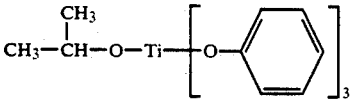 | | A |
| 21 | Isopropyl tri(tri-azine) titanate | 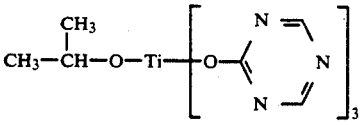 | | A |
| 22 | Isopropyl trihydro-carbonyl titanate | $CH_3-\underset{\vert}{CH}(CH_3)-O-Ti[O-C(=O)-H]_3$ | | A |
| 23 | Isopropyl tri(tri-azinoyl) titanate | 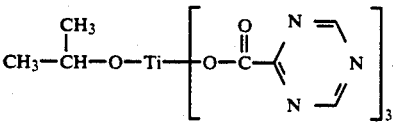 | | A |
| 24 | Isopropyl triaminoyl titanate | $CH_3-\underset{\vert}{CH}(CH_3)-O-Ti[O-C(=O)-NH_2]_3$ | | A |

-continued

| No. | Chemical | Chemical structure | Trade name | Formula |
|---|---|---|---|---|
| 25 | Bis(dioctyl pyro-phosphate) dioxolane titanate | 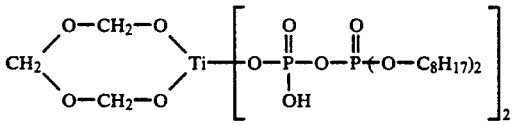 | | B |
| 26 | Bis(dioctyl pyro-phosphate) ethylidene titanate | 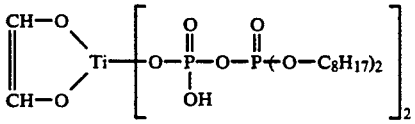 | | B |
| 27 | Ethylene titanate | 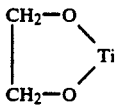 | | B |
| 28 | Isostearoyl ethylene titanate | 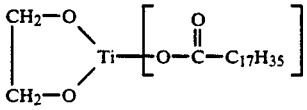 | | B |
| 29 | Triisostear oyl-ethylene titanate | 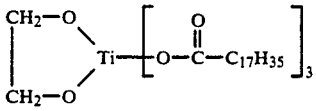 | | B |
| 30 | Trioctyl bis(di-tridecyl phosphite) titanate | $(C_9H_{17}-O\rightarrow_3Ti.[P\leftarrow O-C_{13}H_{27})_2OH]_2$ | | C |
| 31 | Dioctyl bis(ditri-decyl phosphite) titanate | $(C_9H_{17}-O\rightarrow_2Ti.[P\leftarrow O-C_{13}H_{27})_2OH]_2$ | | C |
| 32 | Monooctyl bis(di-tridecyl phosphite) titanate | $(C_9H_{17}-O\rightarrow Ti.[P\leftarrow O-C_{13}H_{27})_2OH]_2$ | | C |

For providing a high $\gamma$ to a photoreceptor to improve the photosensitivity of the photoreceptors, the above-given titanate compounds are each inevitable components of the photoreceptor. For providing such a high $\gamma$ thereto, it is advisable to contain thereinto a titanate compound in an amount within the range of 0.05 to 15 parts by wt. to 100 parts by wt. of a photoconductive organic pigment and, preferably, 0.1 to 10 parts by wt. thereto. If a content of the compound is not proper, a satisfactory $\gamma$ value cannot be obtained, so that any high durability can hardly be obtained.

In the invention, it is particularly desirable that the photoreceptive layer contains an electron-receptive material, besides the above-given compounds, for making the $\gamma$ value and durability more higher. Such electron-receptive materials include, for example, succinic acid anhydride, maleic acid anhydride, dibromomaleic acid anhydride, phthalic acid anhydride, tetrachlorophthalic acid anhydride, tetrabromophthalic acid anhydride, 3-nitrophthalic acid anhydride, 4-nitrophthalic acid anhydride, pyromellitic acid anhydride, mellitic acid anhydride, tetracyanoethylene, tetracyanoquinodimethane, o-dinitrobenzene, m-dinitrobenzene, 1,3,5-trinitrobenzene, paranitrobenzonitrile, picryl chloride, quinonechlorimide, chloranil, bromanil, dichlorodicyanoparabenzoquinone, dichloroparabenzoquinone, anthraquinone, dinitroanthraquinone, 2,7-dinitrofluorenone, 2,4,7-trinitrofluorenone, 2,4,5,7-tetranitrofluorenone, 9-fluorenylidene-(dicyanomethylene malonodinitrile), polynitro-9-fluorenylidene-(dicyanomethylenemalonodinitrile), picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having a substantially greater electron-affinity. The electron affinity is advantageously within the range of 0.5 to 3.0 eV. The content of such an electron-receptive material is within the range of, desirably, 0.1 to 30 parts by wt. to 100 parts by wt. of a photoconductive organic pigment and, preferably, 0.1 to 20 parts by wt. thereto.

If required, the photoreceptive layers are allowed to contain, for example, an antioxidant such as a hindered phenol, a paraphenylenediamine, a hydroquinone, an organic sufur compound, and an organic phosphorus compound.

The thickness of photoreceptive layer 43 is to be within the range of the order of 5 to 200 μm and, preferably, 10 to 100 μm. If the thickness thereof is too thin, a high chargeability can hardly be obtained, so that the high gamma charachteristic which is brought by the avalanche phenomenon can hardly be obtained. On the other hand, if the thickness thereof is too thick, the light-decay characteristic has a long skirt, so that a dot-image having a high sharpness can hardly be obtained.

Figure 4:
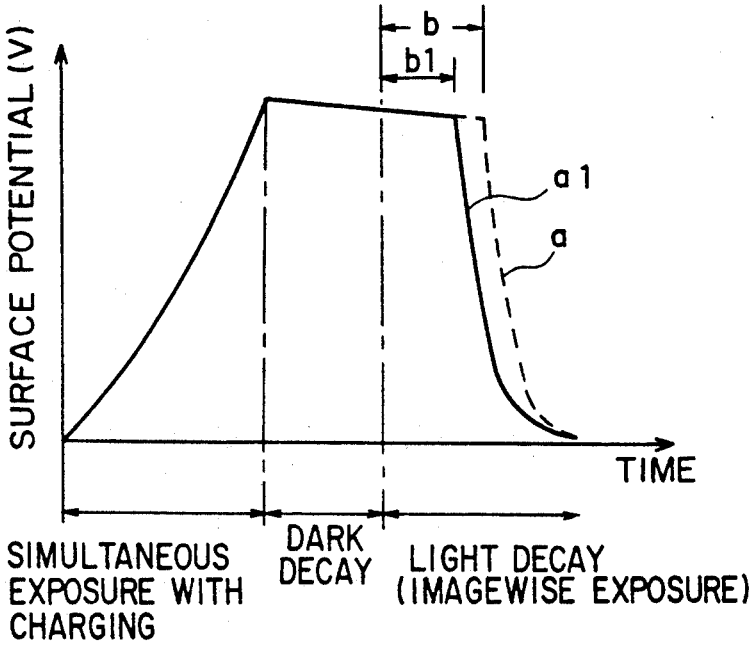

As compared to the conventional photoreceptors capable of giving the high γ type light-decay characteristic shown in FIGS. 6-B and 7, the photoreceptor of the invention produces a sharper light-decay when making an imagewise exposure, as indicated by solid line $a_1$ in FIG. 4, so that higher γ value —the ON/OFF characteristic— can be obtained and the induction period can also be shortened as indicated by $b_1$ therein. This is come from the foregoing titanate compound contained in the photoreceptor. However, it may be presumed tha the presence of the titanate compound effectively causes the charge carrier to trap in a trapping level in the photoreceptor, therefore, carrier the charge caused by the imagewise exposure immediately saturates the trapping level and, resultingly, a remarkably sharp avalanche phenomenon is produced in the middle and latter stages of the imagewise exposure, so that ultrahigh γ characteristic may be displayed.

Aa shown in FIG. 8, also in the characteristic of repletion use, surface potential $V_L$ in the exposed area and surface potential $V_H$ in the nonexposed area are each improved in durability without any substantial fluctuation against time passage.

EMBODIMENT [V]

The other examples of the embodiments of the invention will now be detailed. It is, however, to be understood that the embodiments of the invention shall not be limited thereto.

EXAMPLE V-1

The coating slurry having the following composition was coated on the aluminium tube for the photoreceptor drum of a digital copier, Model DC-8010 manufactured by Konica Corp.

| | |
|---|---|
| An X-type metal-free phthalocyanine pigment, Fastogen Blue 8120 made by Dai-Nippon Ink Co. | 20 parts by wt. |
| Polyester, Almatex P-645 made by Mitsui-Toatsu Chemical Co. | 67 parts by wt. |
| Melamine resin, UVAN 21R made by Mitsui-Toatsu Chemical Co. | 40 parts by wt. |
| Flow-Control agent, Resimix RL-4 made by Mitsui-Toatsu Chemical Co. | 2 parts by wt. |
| Titanate type compound (a), Prene-Act TTS made by Ajinomoto Co. | 0.1 parts by wt. |
| Electron-receptive material (1), Chloranil | 0.02 parts by wt. |
| Tetrahydrofuran | 400 parts by wt. |

The above-given compositions were dispersed for 3 hours with a sand grinder, thereby preparing a dispersion. The glass beads used were Hi-Bea No. 8 made by Ohara Co. having a bead-size within the range of 2.4 to 4.0 mm. The resulting dispersion was coated, in a dipping method, on the aluminium tube having a diameter of 150 mm and was then dried up at 150° C. for one hour, thereby preparing a photoreceptive layer having a thickness of 19 μm. Under the photoreceptive layer, an interlayer comprising polyvinyl alcohol having a thickness of several μm was provided in advance.

EXAMPLES V-2 TO V-10 AND COMPARATIVE EXAMPLES IV-1 TO IV-2

In the same manner as in Example V-1, each of the photoreceptors was prepared by adding the following titanate type compounds (b), (c) and (d), and the following electron-receptive materials (2), (3) and (4), each in the proportions given in Table V-1, thereby preparing each of the photoreceptors, respectively.

Titanate Type Compounds (b) Prene-Act 46B made by Ajinomoto Co.;
(c) Prene-Act 55 made by Ajinomoto Co.; and
(d) Prene-Act 138S made by Ajinomoto Co.

Electron-Receptive Materials (2)

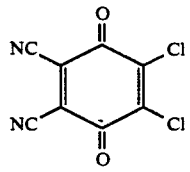

Dichlorodicyanoparabenzoquinone;

(3)

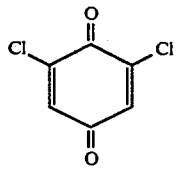

Dichloroparabenzoquinone;

and (3)

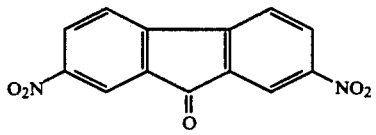

2,7-Dinitrofluorenone

TABLE V-1

| | Pigment | | Titanate type compound | | Electron-receptive material | |
|---|---|---|---|---|---|---|
| | Type | Content | Kind | Content | Kind | Content |
| Inventive Example V-2 | X-type nonmetallic pthalocyanine | 20 wt parts | (b) | 0.1 wt parts | (1) | 0.5 wt parts |
| Inventive Example V-3 | X-type nonmetallic pthalocyanine | 20 wt parts | (c) | 0.5 wt parts | (1) | 0.02 wt parts |
| Inventive Example V-4 | τ-type nonmetallic phthalocyanine* | 20 wt parts | (d) | 3.0 wt parts | (2) | 0.5 wt parts |

TABLE V-1-continued

| | Pigment | | Titanate type compound | | Electron-receptive material | |
|---|---|---|---|---|---|---|
| | Type | Content | Kind | Content | Kind | Content |
| Inventive Example V-5 | τ-type nonmetallic phthalocyanine* | 20 wt parts | (b) | 0.01 wt parts | (2) | 6.0 wt parts |
| Inventive Example V-6 | α-type nonmetallic phthalocyanine | 20 wt parts | (b) | 1.0 wt parts | (3) | 4.0 wt parts |
| Inventive Example V-7 | α-type nonmetallic phthalocyanine | 20 wt parts | (a) | 0.5 wt parts | (4) | 4.0 wt parts |
| Inventive Example V-8 | α-type nonmetallic phthalocyanine | 20 wt parts | (c) | 0.02 wt parts | (4) | 0.02 wt parts |
| Inventive Example V-9 | α-type nonmetallic phthalocyanine | 20 wt parts | (c) | 2.0 wt parts | (4) | 0.1 wt parts |
| Inventive Example V-10 | α-type nonmetallic phthalocyanine | 20 wt parts | (a) | 12.0 wt parts | — | — |

*Liphoton Blue made by Toyo Ink Co.

Black-and-white images were each made in the following manner: One of the resulting photoreceptor drums was loaded onto a digital copier shown in FIG. 1-*a*, Remodeled DC-8010 manufactured by Konica Corp. and the surface of the photoreceptor was uniformly charged; the surface thereof was exposed to a semiconductor laser beam modulated by a digital signal so as to form a dot-shaped electrostatic latent image; the resulting latent image was developed, in a contact-reversal developing method, with a dual component type developer comprising nonmagnetic toner having an average particle-size of 5 μm and resin-coated ferrite carrier having an average particle-size of 20 μm, in the state where a 500 V DC bias voltage was applied to the development gap; the resulting developed image was transferred to a plain paper and was then fixed. In this instances, the surface potentials of the photoreceptors were each measured in the position of the developing unit using a known surface potentiometer, Model AA-2404 manufactured by Ando Electric Co.

The results obtained from the above-described examples are shown in Table V-2 given below.

TABLE V-2

| | At the start | | | In the 100th copy cycle | | |
|---|---|---|---|---|---|---|
| | $V_H$ (V) | $V_L$ (V) | Image | $V_H$ (V) | $V_L$ (V) | Image |
| Inventive Example V-1 | +700 | +120 | Excellent | +700 | +100 | Excellent |
| Inventive Example V-2 | +700 | +120 | Excellent | +690 | +100 | Excellent |
| Inventive Example V-3 | +700 | +110 | Excellent | +700 | +100 | Excellent |
| Inventive Example V-4 | +700 | +90 | Excellent | +690 | +90 | Excellent |
| Inventive Example V-5 | +700 | +100 | Excellent | +700 | +90 | Excellent |
| Inventive Example V-6 | +700 | +90 | Excellent | +700 | +80 | Excellent |
| Inventive Example V-7 | +700 | +90 | Excellent | +700 | +90 | Excellent |
| Inventive Example V-8 | +700 | +110 | Excellent | +690 | +80 | Excellent |
| Inventive Example V-9 | +700 | +100 | Excellent | +700 | +90 | Excellent |
| Inventive Example V-10 | +700 | +130 | Excellent | +680 | +90 | Excellent |

From the results shown in the above table, it was found from the inventive examples based on the invention that the high-quality and stable images were obtained from the start.

In addition to the above, a sheet sample was prepared by wrapping a 75 μm thick polyethyleneterephthalate film sheet vacuum-evaporated thereon with aluminium around an aluminium tube and, further thereon, a photoreceptive layer was formed in the same manner as in the foregoing example.

The resulting sheet sample was loaded on a photoreceptor tester, Model EPA-8100 manufactured by Kawaguchi Electric Co. and the electrostatic characteristics of the photoreceptors were measured with 780 nm monochromatic light having a light intensity of 10 μW as a beam for making the exposure.

As the results, the typical characteristics thereof were equivalent to those shown in FIG. 4. The resulting photoreceptors had the characteristics having a maximum value of the differential coefficient to the light amount on the light-decay curves, as described of FIG. 7. The results of the measurements are detailed in Table V-3. Induction period range $|_D$ is expressed by an exposure energy denoted by b or $b_1$ shown in FIG. 4, and $E^{600}_{100}$ indicates an exposure energy necessary to lowering the surface potentials from 600 V to 100 V.

TABLE V-3

| | Charge potential $V_1$, (V) | Initial potential $V_o$, (V) | Induction range $\|_D$, (μJ/cm²) | $E^{600}_{100}$ (μJ/cm²) |
|---|---|---|---|---|
| Inventive Example V-1 | +800 | +770 | 33 | 17 |
| Inventive Example V-2 | +820 | +780 | 35 | 5 |
| Inventive Example V-3 | +810 | +780 | 32 | 11 |
| Inventive Example V-4 | +820 | +780 | 40 | 16 |
| Inventive Example V-5 | +850 | +810 | 36 | 10 |
| Inventive Example V-6 | +800 | +770 | 33 | 12 |
| Inventive Example V-7 | +810 | +780 | 35 | 7 |
| Inventive Example V-8 | +810 | +790 | 32 | 9 |
| Inventive Example V-9 | +820 | +790 | 36 | 11 |
| Inventive Example V-10 | +800 | +760 | 38 | 20 |
| Comparative Example V-1 | +810 | +780 | 39 | 56 |
| Comparative Example V-2 | +800 | +770 | 39 | 50 |

From the results shown above, the photoreceptors based on the invention could improve the photosensitivity and display the high $\gamma$ characteristics, as compared to the comparative examples.

ADVANTAGES OF THE INVENTION

In the invention, as described above, a photoreceptor having a maximum value of the differential coefficient to the light amount on the light-decay curve contains a titanate type coupling agent having a specific structure. It is, therefore, capable of improving the photosensitivity to make the $\gamma$ value more higher and to keep the repetition use stable.

What is claimed is:

1. A method of forming an image on a photoreceptor, comprising:
   charging the surface of the photoreceptor;
   forming a latent image on the surface of the photoreceptor by a dot-wise image exposure;
   developing the latent image on the surface of the photoreceptor;
wherein the photoreceptor exhibits a peak in its differential coefficient to imagewise exposure curve, and the amount of dot-wise imagewise exposure per pixel for a solid image is greater than that for a thin line image.

2. The method of claim 1, further comprising a step of uniformly exposing the surface of the photoreceptor substantially at the same time with the step of the charging.

3. The method of claim 1, wherein the light amount of the uniform exposure is controlled in accordance with the repetition number of the copy process cycle.

4. The method of claim 1, wherein the light amount of uniform exposure for a region of a solid image is greater than that for a region of a thin lime image.

5. The method of claim 1, wherein said photoreceptor comprises a phthalocyanine compound; an antioxidant having a hindered phenol structural unit; and an electron-acceptive substance;
   wherein the proportion of the antioxidant and the electron-acceptive substance each to the phthalocyanine compound, in term of weight proportion, is as follows:

$$0.1 \leqq (\text{Antioxidant/Phthalocyanine compound}) \times 100 < 50$$

$$0.1 \leqq (\text{Electron acceptive substance/Phthalocyanine compound}) \times 100 < 40$$

6. The method of claim 1, wherein a photoreceptor comprises the titanate type compound represented by the following formulas A, B or C:

Formula A:

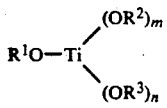

wherein $R^1$, $R^2$ and $R^3$ represent each a hydrogen atom, a substituted or unsubstituted ally group, a substituted or unsubstituted aryl group, a substituted or unsubstituted heterocyclic group, a substituted or unsubstituted alkyl group, or one of the groups represented by the following formulas:

Formulas:

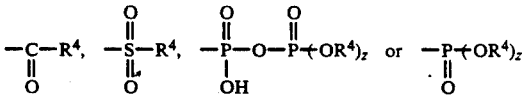

wherein $R^4$ represents a hydrogen atom, a substituted or unsubstituted allyl group, a substituted or unsubstituted aryl group, a substituted or unsubstituted heterocyclic group, a substituted or unsubstituted alkyl group, or a substituted or unsubstituted amino group, and m and n are each an integer of 0, 1, 2 or 3, Formula B:

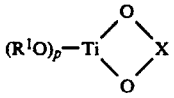

wherein $R^1$ is synonymous with the above-denoted $R^1$, X represents a cycloalkane forming group, a cycloalkene forming group, a heterocyclic ring forming group, or a cycloalkylketone ring forming group, and p is an integer of 0, 1, 2 or 3, Formula C:

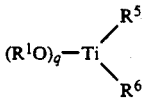

wherein $R^1$ is synonymous with that denoted above, and $R^5$ and $R^6$ are each one of the groups represented by the following formula:

Formula:

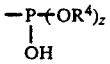

wherein $R^4$ is synonymous with that denoted above, and q is an integer of 1, 2, 3 or 4.

7. A method of forming an image on a photoreceptor having a given decay characteristic in which, when the amount of exposure is below a critical value, the electric potential of said photoreceptor only drops slightly, and when the amount of exposure exceeds said critical value, the potential drops sharply; comprising
   electrically charging the photoreceptor;
   exposing the photoreceptor uniformly substantially at the same time as said charging with the amount of uniform exposure below said critical value;
   exposing the photoreceptor with an imagewise exposure according to an image information to form a latent image,
   developing said latent image to form toner image; and
   reducing the amount of uniform exposure in accordance with the number of repeated image forming process cycles.

* * * * *